US010148048B2

(12) United States Patent
Larsson et al.

(10) Patent No.: US 10,148,048 B2
(45) Date of Patent: Dec. 4, 2018

(54) TOOLLESS COMMUNICATIONS JACK

(71) Applicant: Communications Systems, Inc., Minnetonka, MN (US)

(72) Inventors: Nicholas B. Larsson, Blomkest, MN (US); George I. Wakileh, Batavia, IL (US)

(73) Assignee: Communications Systems, Inc., Minnetonka, MN (US)

( * ) Notice: Subject to any disclaimer, the term of this patent is extended or adjusted under 35 U.S.C. 154(b) by 0 days.

(21) Appl. No.: 15/550,986

(22) PCT Filed: Jun. 7, 2017

(86) PCT No.: PCT/US2017/033130
§ 371 (c)(1),
(2) Date: Aug. 14, 2017

(87) PCT Pub. No.: WO2017/201177
PCT Pub. Date: Nov. 23, 2017

(65) Prior Publication Data

US 2018/0131146 A1 May 10, 2018

Related U.S. Application Data

(60) Provisional application No. 62/339,582, filed on May 20, 2016.

(51) Int. Cl.
*H01R 4/2433* (2018.01)
*H01R 24/64* (2011.01)
(Continued)

(52) U.S. Cl.
CPC ..... *H01R 24/64* (2013.01); *H01R 4/2433* (2013.01); *H01R 13/506* (2013.01); *H01R 13/6463* (2013.01); *H01R 43/01* (2013.01)

(58) Field of Classification Search
CPC .... H01R 4/2433; H01R 24/64; H01R 13/502; H01R 13/506; H01R 43/01
(Continued)

(56) References Cited

U.S. PATENT DOCUMENTS 4,261,633 A 4/1981 Abernethy
4,426,125 A * 1/1984 Crawford ..... H01R 12/675 439/404
(Continued)

FOREIGN PATENT DOCUMENTS

JP 2008524828 7/2008

OTHER PUBLICATIONS

"Cat5e 1101DC Toolless Network Keystone Jack Outlet for Wall Mount Box," Product webpage, http://easycablings.sell.dowin.com/p-101147675-cat5e-110idc-toolless-network-keystone-jack-outlet-for-wall-mount-box.html, retrieved Apr. 11, 2016 (3 pages).
(Continued)

*Primary Examiner* — Vanessa Girardi
(74) *Attorney, Agent, or Firm* — Pauly, DeVries Smith & Deffner LLC

(57) ABSTRACT

A jack has a housing with terminals extending from opposite sides of a terminal support. Toggles coupled to the housing include passages for receiving cable wires. Closing the toggles engages the terminals and terminates wires inserted in the passages without using a special punch down tool. Viewing apertures in the toggles are connected to the wire passages and let a person see whether wires are fully inserted into the toggles for proper connection to the terminals. In some cases the toggles are pivotally coupled to the housing and adjacent the opposite sides of the terminal support, and insertion ends of the toggles face away from the jack plug opening. The jack can have a modular configuration or an integral mounting plate. A method for terminating wires
(Continued)

includes inserting untwisted wire ends into the toggles and pivoting the toggles to intersect the wire ends with electrical terminals.

20 Claims, 16 Drawing Sheets

(51) Int. Cl.
*H01R 13/506* (2006.01)
*H01R 43/01* (2006.01)
*H01R 13/6463* (2011.01)

(58) Field of Classification Search
USPC ..... 439/409, 410, 676
See application file for complete search history.

(56) References Cited

U.S. PATENT DOCUMENTS

| | | | |
|---|---|---|---|
| 4,451,106 | A | 5/1984 | Wiseheart et al. |
| 5,107,712 | A | 4/1992 | Field et al. |
| 5,358,430 | A | 10/1994 | Bonvallat et al. |
| 5,667,402 | A | 9/1997 | Denovich et al. |
| 5,762,518 | A | 6/1998 | Tanigawa et al. |
| 5,938,479 | A | 8/1999 | Paulson et al. |
| 5,947,761 | A | 9/1999 | Pepe |
| 5,957,720 | A | 9/1999 | Boudin |
| 6,065,995 | A | 5/2000 | Furukawa |
| 6,080,006 | A | 6/2000 | Broder |
| 6,113,419 | A | 9/2000 | Finley et al. |
| 6,254,421 | B1 | 7/2001 | Denovich et al. |
| 6,287,149 | B1 | 9/2001 | Hammond |
| 6,682,363 | B1 | 1/2004 | Chang |
| 6,793,540 | B2 | 9/2004 | Peng |
| 7,066,764 | B2 | 6/2006 | Bolouui-Saransar |
| 7,118,405 | B2 | 10/2006 | Peng |
| 7,134,904 | B2 | 11/2006 | Bergner et al. |
| 7,249,961 | B1 | 7/2007 | Provenzano |
| D552,551 | S | 10/2007 | Chang |
| D553,088 | S | 10/2007 | Chang |
| 7,540,760 | B1 | 6/2009 | Chen |
| 7,572,140 | B2 | 8/2009 | Szelag et al. |
| 7,758,372 | B2 | 7/2010 | Jaouen et al. |
| 7,942,689 | B1 | 5/2011 | Huss, Jr. et al. |
| 7,985,100 | B2 | 7/2011 | Jaouen et al. |
| 8,011,949 | B2 | 9/2011 | Foratier et al. |
| 8,070,506 | B2 | 12/2011 | Martin et al. |
| 8,105,105 | B2 | 1/2012 | Taniguchi et al. |
| 8,192,224 | B2 | 6/2012 | Schmidt et al. |
| 8,215,980 | B1 | 7/2012 | Lin |
| 8,333,607 | B1 | 12/2012 | Moldoch et al. |
| 8,496,500 | B1 | 7/2013 | Wu |
| 8,568,176 | B2 | 10/2013 | Huang et al. |
| 8,573,999 | B2 | 11/2013 | Feldner et al. |
| 8,613,633 | B2 | 12/2013 | Pachon et al. |
| 8,790,139 | B2 | 7/2014 | Fitzpatrick |
| 9,093,760 | B2 | 7/2015 | Weikle et al. |
| 9,130,329 | B1 | 9/2015 | Wu et al. |
| 2004/0142592 | A1 | 7/2004 | Peng et al. |
| 2006/0030192 | A1 | 2/2006 | Boeck et al. |
| 2009/0029599 | A1 | 1/2009 | Jaouen et al. |
| 2010/0029122 | A1 | 2/2010 | Mateo Ferrus et al. |
| 2011/0076898 | A1 | 3/2011 | Taniguchi et al. |
| 2011/0300740 | A1 | 12/2011 | Schumann et al. |
| 2012/0031668 | A1 | 2/2012 | Takasaki |
| 2012/0309238 | A1 | 12/2012 | Huang et al. |
| 2015/0194767 | A1 | 7/2015 | Hashim et al. |
| 2015/0263466 | A1 | 9/2015 | Fransen |

OTHER PUBLICATIONS

"Cat5e Keystone Jack RJ45 Toolless 90 Degree," Product webpage, http://cnlianchuang.en.alibaba.com/product/442533633-212463757/cat5e_keystone_jack_rj45_toolless_90degree.html, retrieved Apr. 11, 2016 (4 pages).
"Cat5e RJ45 UTP Shielded Toolless Keystone Jack," Product webpage, http://www.cablestogo.com/product/35228/cat5e-rj45-utp-shielded-toolless-keystone-jack#specs, retrieved Apr. 5, 2016 (3 pages).
"Cat6 RJ-45 Toolless Keystone—Orange," Product webpage, http://www.monoprice.com/product?p_id=5623, retrieved Apr. 5, 2016 (3 pages).
"EZ-SnapJack," Product specification page, Platinum Tools Inc, 2015 (2 pages).
"Ftp Cat6 Toolless Network Keystone Jack RJ45 110 IDC Metal 180 Degree with Cable Holder," Product webpage, http://easycablings.sell.nccecojustice.org/pz669f779-ftp-cat6-toolless-network-keystone-jack-rj45-110-idc-metal-180-degree-with-cable-holder.html, retrieved Apr. 11, 2016 (4 pages).
"How to Connect a Cat5e/Cat6 RJ-45 Tooless Keystone Jack," http://www.monoprice.com/manual/How%20to%20-%20tooless%20keystone.pdf, retrieved Apr. 5, 2016 (3 pages).
"International Search Report and Written Opinion," for PCT Application No. PCT/US2017/033130 dated Aug. 18, 2017 (13 pages).
"MediaMAX Data Termination Modules," Product specification page, Suttle Inc., 2016 (2 pages).
"Smt-1017T6c3 Cat.3 Telephone Unshielded Tooless 6p6c RJ12 Keystone Jack," Product webpage, http://hightekchina.com/product/smt-1017t6c3-204.html#, retrieved Apr. 12, 2016 (3 pages).
"SpeedStar Category 5e Modular Jacks," Product specification page, Suttle Inc., 2014 (1 page).
"SpeedStar Single & Double Gang Smooth Faceplates," Product specification page, Suttle Inc., 2014 (1 page).
"Tool-less Data Module," Product specification page, Suttle Inc., 2014 (1 page).
Wikipedia.org, "Category 5 Cable," https://en.wikipedia.org/wiki/Category_5_cable, retrieved Apr. 26, 2016 (6 pages).

* cited by examiner

TOOLLESS COMMUNICATIONS JACK

PRIORITY

This application is being filed as a PCT International Patent application on May 17, 2017, in the name of Communications Systems, Inc., a U.S. national corporation, applicant for the designation of all countries, and Nicholas B. Larsson, a U.S. Citizen, and George I. Wakileh, a U.S. Citizen, inventors for the designation of all countries, and claims priority to U.S. Provisional Patent Application No. 62/339,582, filed May 20, 2016, the content of which is incorporated herein by reference in its entirety.

FIELD

This disclosure is generally related to connectors for terminating and connecting communications cables. More specifically, the disclosure herein relates to a communications jack with features for terminating cable wires without the use of special termination tools.

BACKGROUND

Communications cables are frequently terminated with a connector that can be used to removably connect one communications cable with another. Telephone cables and computer network cables are two examples of communications cables that are often terminated with connectors. Examples of these types of connectors include plugs and jacks. Commercially available plugs and jacks can have a variety of configurations. One extremely common configuration is the 8P8C (8 position, 8 contact) connector configuration for jacks and plugs, which is also often referred to as an RJ45 connector configuration. This standardized configuration is used for, among other things, connecting computer networking cables.

A typical jack (8P8C, RJ45 or otherwise) has a number of electrical terminals or contacts for electrically connecting wires of a cable to the jack. The jack also has a receptacle configured to receive a matching plug that is electrically connected to another cable. The process of connecting the individual wires in a cable to a jack can involve a number of different steps depending on the design of the jack and the number and type of wires within the cable. As just one example, terminating a Category 5E cable at an 8P8C/RJ45 jack involves, among other things, making individual electrical connections between each of eight twisted pair wires in the Cat 5E cable and a corresponding jack terminal. In cases in which the jack includes insulation displacement contacts (IDCs), a special punch down tool is often used to ensure that each wire is sufficiently inserted into the IDC to make electrical contact with the terminal.

As communications cables, such as those used in computer networks, become ever more prevalent within homes and businesses, communications connectors (e.g., computer network jacks) are needed in numerous locations to quickly and reliably connect to the communications cables. While technicians and some homeowners are capable of installing these types of connectors, often with the use of special tools, there remains a desire to simplify or otherwise improve the communications connectors and the installation process, including the steps for terminating cable wires at the jack.

SUMMARY

A few possible implementations of various features according to some embodiments will now be described. One possible implementation includes a modular jack that has, among other things, a housing including a connection end, a termination end, and a terminal support. The connection end has a plug opening configured to receive a cable plug and the termination end is located opposite and facing away from the connection end. The terminal support includes a first side and a second side opposite the first side, the first and second sides located between the connection end and the termination end. The modular jack also includes a plurality of first side terminals and a plurality of second side terminals. The modular jack also includes a first toggle adjacent to the first side of the terminal support, the first toggle including an insertion end proximate the termination end of the housing, facing away from the plug opening, a pivot end pivotally coupled to the housing between the connection end and the termination end, and a first body extending between the insertion end and the pivot end. The first body includes a plurality of separate first wire passages and a plurality of first terminal channels. The modular jack also includes a second toggle adjacent to the second side of the terminal support, the second toggle including an insertion end proximate the termination end of the housing, facing away from the plug opening, a pivot end pivotally coupled to the housing between the connection end and the termination end, and a second body extending between the insertion end and the pivot end, the second body including a plurality of separate second wire passages and a plurality of second terminal channels. The modular jack in this implementation also includes the following configurations. Each of the first and second wire passages extends into the first and second bodies, respectively, from the insertion ends of the first and second toggles, respectively. Each of the first and second wire passages is configured to receive an end of a wire from a communications cable in a single insertion motion. Each of the first terminal channels guides one of the first side terminals through a section of one of the first wire passages to terminate a wire therein as the first toggle is pivoted from an open position to a closed position. Each of the second terminal channels guides one of the second side terminals through a section of one of the second wire passages to terminate a wire therein as the second toggle is pivoted from an open position to a closed position.

Implementations of the modular jack may include one or more of the following features and configurations. In some cases each of the first and second wire passages extends from a first end at the insertion end of the first and second toggles, respectively, to a second end located within the first and second toggles, respectively. In some cases at least one of the first and second toggles includes a viewing aperture in communication with the second end of at least one wire passage. In some cases each of the first and second wire passages includes a funnel portion at the first end and a straight portion between the funnel portion and the second end. In some cases the housing includes first side walls extending from the first side of the terminal support, and second side walls extending from the second side of the terminal support opposite the first side walls. In some cases the first toggle is pivotally coupled between the first side walls and the second toggle is pivotally coupled between the second side walls. In some cases the housing includes a terminal portion and a connector portion that are removably connected. In some cases the housing includes a terminal portion including removably connected first and second halves, where the first toggle is pivotally coupled to the first half and where the second toggle is pivotally coupled to the second half. In some cases the housing further includes a first catch system for the first toggle and a second catch system for the second toggle, each of the catch systems including two detent members configured to alternately maintain the corresponding toggle in the open position and in the closed position.

Another possible implementation includes a method for terminating a communications cable. The method includes removing a length of cable jacket from an end of a communications cable including multiple pairs of twisted wires, separating the pairs of twisted wires at the end of the communications cable, and untwisting the ends of each pair of twisted wires. The method also includes bringing the end of the communications cable near a communications jack. The communications jack includes a cable plug opening and first and second toggles pivotally coupled on opposite sides of a terminal support. The communications jack also includes first side terminals and second side terminals extending from corresponding first and second sides of the terminal support. Each of the first and second toggles have an insertion end facing away from the plug opening and a pivot end opposite the insertion end. The method also includes inserting, with a single motion, the untwisted ends of a first pair of twisted wires into two first wire passages in the insertion end of the first toggle and inserting, with a single motion, the untwisted ends of a second pair of twisted wires into another two first wire passages in the insertion end of the first toggle. The method also includes pivoting the first toggle toward the first side of the terminal support to intersect each of the first wire passages with a corresponding first side terminal, thereby forming an electrical connection between each of the wires of the first and second pairs of twisted wires and corresponding first side terminals. The method also includes inserting, with a single motion, the untwisted ends of a third pair of twisted wires into two second wire passages in the insertion end of the second toggle and inserting, with a single motion, the untwisted ends of a fourth pair of twisted wires into another two second wire passages in the insertion end of the second toggle. The method also includes pivoting the second toggle toward the second side of the terminal support to intersect each of the second wire passages with a corresponding second side terminal, thereby forming an electrical connection between each of the wires of the third and fourth pairs of twisted wires and corresponding second side terminals.

Implementations of the method for terminating a communications cable may include one or more of the following features and configurations. In some cases the first wire passages extend into the first toggle but not through the pivot end of the first toggle, and the second wire passages extend into the second toggle but not through the pivot end of the second toggle. In some cases the method includes viewing the inserting the untwisted ends of the first and second pairs of twisted wires through one or more viewing apertures in the first toggle and viewing the inserting the untwisted ends of the third and fourth pairs of twisted wires through one or more viewing apertures in the second toggle. In some cases the method includes pivoting the first and the second toggles away from the first and second sides of the terminal support, respectively, before inserting the untwisted ends of the pairs of twisted wires into the first and second wire passages. In some cases the method includes maintaining a rotation of the first and the second toggles away from the terminal support with a detent system. In some cases the method includes pivoting the first and the second toggles into first and second termination bays, respectively, wherein the first termination bay comprises first side walls and the first side of the terminal support, and wherein the second termination bay comprises second side walls and the second side of the terminal support. In some cases the method includes attaching the jack to a mounting plate. In some cases the jack is integrally attached to a mounting plate.

Another possible implementation includes a communications jack that includes a mounting plate configured to be mounted to a support surface, the mounting plate including an inner side configured to face the support surface, an outer side opposite the inner side, and an opening extending through the outer and inner sides, the opening configured to receive a cable plug. The communications jack also includes a housing including a connector portion connected to the mounting plate and a terminal portion connected to the connector portion opposite the mounting plate. The connector portion includes a plug receptacle in communication with the opening of the mounting plate. The terminal portion includes a terminal support including first side terminals and second side terminals extending from corresponding first and second sides of the terminal support. The communications jack also includes first and second toggles pivotally coupled on opposite sides of the terminal support, each of the first and second toggles including an insertion end facing away from the mounting plate, a pivot end opposite the insertion end, and four wire passages extending into the toggle from the insertion end but not extending through the pivot end. Each of the wire passages is configured to receive an end of a wire from a communications cable in a single insertion motion. Each of the first and second toggles also includes four terminal channels, each one of the terminal channels intersecting a corresponding wire passage. The communications jack in this implementation also includes the following configurations. Each of the first and the second toggles has an open position in which the toggle is rotated away from the terminal support for loading ends of wires into the wire passages of the toggle. Each of the first and the second toggles has a closed position in which the toggle is rotated toward the terminal support. Rotating the first and second toggles from the open positions to the closed positions, respectively, inserts corresponding first side and second side terminals into the terminal channels of the first and second toggles, respectively, to electrically terminate ends of wires in the wire passages of the toggle.

Implementations of the communications jack may include one or more of the following features and configurations. In some cases the terminal portion and the connector portion are removably connected. In some cases the first toggle includes a first viewing aperture in communication with two wire passages in the first toggle and a second viewing aperture in communication with another two wire passages in the first toggle, and the second toggle includes a third viewing aperture in communication with two wire passages in the second toggle and a fourth viewing aperture in communication with another two wire passages in the second toggle. In some cases the terminal portion further includes a first catch system for the first toggle and a second catch system for the second toggle, each of the catch systems comprising two detent members configured to alternately maintain the corresponding toggle in the open position and in the closed position.

BRIEF DESCRIPTION OF THE FIGURES

This disclosure may be more completely understood in connection with the following drawings.

Figure 1:
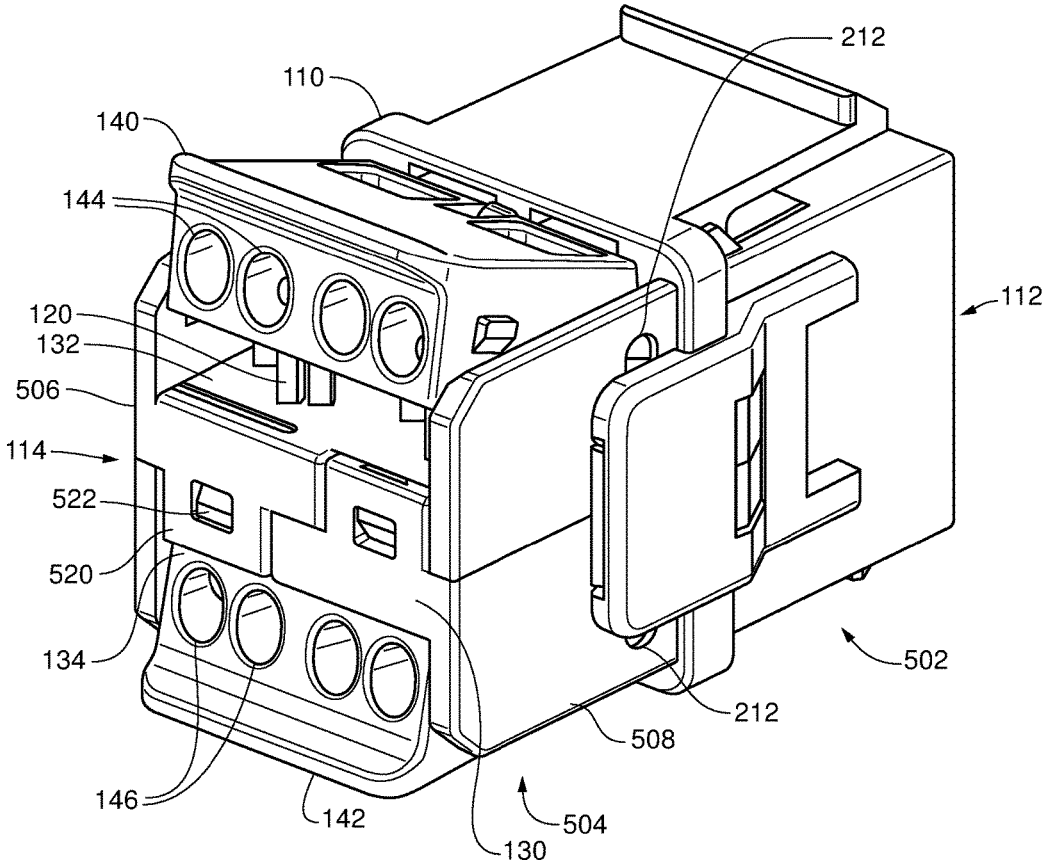
FIG. 1 is a perspective view of a modular communications jack according to various embodiments.

While embodiments are susceptible to various modifications and alternative forms, specifics thereof have been shown by way of example and drawings, and will be described in detail. It should be understood, however, that the scope herein is not limited to the particular embodiments described. On the contrary, the intention is to cover modifications, equivalents, and alternatives falling within the spirit and scope of the teachings herein.

DETAILED DESCRIPTION

The embodiments described herein are not intended to be exhaustive or to limit the invention to the precise forms disclosed in the following detailed description. Rather, the embodiments are chosen and described so that others skilled in the art can appreciate and understand the principles and practices.

Examples of connectors for terminating communications cables are described herein, as are examples of methods for terminating a communications cable. While many embodiments are possible, selected embodiments related to communications cable jacks and methods for terminating cables at such jacks are described herein. It should be appreciated that various embodiments may incorporate different combinations, subsets, and/or portions of the teachings (e.g., the elements, features, benefits, and/or steps) in this disclosure.

Various embodiments relate to terminating horizontal, unshielded, twisted pair (UTP) cables. Some implementations involve terminating the wires of a cable having four twisted pairs of wires. Examples of applicable cables include, but are not limited to, Category 3, 5, 5E, 6, and 6A networking cables. Such embodiments can likewise involve a jack with a plug opening capable of receiving and terminating a corresponding plug. As just one example, the plug opening can be configured to receive an 8P8C or RJ45 type plug. Thus, the jack can be an example of an RJ45 jack. While various examples are directed to these types of computer network cables, jacks, and plugs, it should be appreciated that the teachings herein are applicable to other types of cables and connectors as well.

Various embodiments provide jack features that facilitate the wire termination process. For example, some jack embodiments enable a simpler termination process and/or fewer steps than are associated with some existing jacks. In some cases a jack can be described as "toolless" or "toolless" because a person can terminate wires at the jack without the need for special tools. One type of special tool that has been used in the past, but that is not needed for various embodiments of the invention, is a punch down tool.

According to various embodiments, a jack includes one or more toggles that enable termination of cable wires without a punch down tool. In some cases one or more toggles are actuated from an open position to a closed position to terminate cable wires located within the toggle(s). Some jacks have multiple insulation displacement contact (IDC) terminals. In some cases actuating one or more toggles moves cable wires into the IDC terminals to create electrical connections between the IDC terminals and the cable wires without the use of special tools. This can be especially useful for homeowners and others who may not have ready access to special tools, such as a punch down tool.

In various embodiments, a jack includes toggles that are pivotally coupled to a jack housing. The toggles each have an insertion end that has openings leading into multiple wire passages. According to some implementations, the insertion end of each toggle is next to a termination end of the housing and faces away from a connection end of the jack housing. The connection end of the housing includes a plug opening for receiving a modular cable plug. In this arrangement, the other end of each toggle (e.g., the end opposite the insertion end) is pivotally coupled to the jack housing between the connection end of the housing and the termination end of the jack housing.

In various implementations, a jack includes a toggle with multiple wire passages. Terminating a twisted pair wire involves inserting the wire into one of the wire passages and then pivoting or rotating the toggle into a closed position. As the toggle is pivoted, an electrical terminal intersects the wire passage and the toggle forces the wire into electrical contact with the terminal. In some cases terminating the wire involves inserting the wire into the wire passage in a single motion, and then pivoting the toggle closed, without any further steps. For example, in various embodiments, a user does not need to strip the wire's insulation and/or does not need to trim excess wire length after pivoting the toggle into a closed position.

In various cases, a wire is inserted straight into a wire passage in the toggle, but does not need to be further positioned or manipulated aside from rotating the toggle closed. For example, in some cases a user can insert a wire into a straight wire passage and does not need to bend the wire, secure it within a clip or load bar, or otherwise manipulate the wire. The toggle is then pivoted closed. This sequence of inserting the wire and then pivoting the toggle to terminate the wire provides a straightforward and in some cases simpler termination method than is available in some existing jacks.

In various embodiments, a jack has one or more toggles that each have pairs of wire passages (e.g., two pair, four pair, or more) aligned in a row. In some cases a jack has two toggles, each of which has four wire passages aligned in a row. Such arrangements can facilitate the simultaneous insertion of two or more wires into a toggle. According to some embodiments, one or two pairs of wires can be inserted in a single insertion motion into corresponding wire passages in a toggle. Of course this is one possible arrangement of the wire passages that can be utilized in various embodiments. In some embodiments the wire passages may not be aligned in a row, may be offset from each other, and/or have another different configuration.

Various implementations of a jack and/or termination method include the use of a toggle that provides multiple separate wire passages for receiving and terminating twisted pair wires. According to some embodiments, a toggle has an integral body that defines each of the wire passages extending there in. As one example, a toggle may be formed from a solid mass having multiple wire passages extending through the interior of the toggle. As another example, a toggle may be formed from a hollow shell with a wall that defines multiple wire passages through the toggle. According to various embodiments, a wire passage is generally straight, meaning that it at least extends into the body along a longitudinal axis. In some cases one or more or all portions of a wire passage may be formed as a cylindrical opening, though this geometry is not required. In some cases the diameter or width of a passage may change one or more times along its longitudinal extent.

According to some embodiments the wire passages extend into the toggle body and the body encloses the sides of the passages. Enclosing the sides of the wire passages can facilitate wire insertion since the walls of the body/passage can guide the wire as it is inserted. In various embodiments, wire passages extend into the toggle body from an insertion end of the toggle body. In some cases a wire passage increases in diameter near the insertion end of the toggle to form a funnel portion that can guide a wire into a further straight portion of the passage within the toggle body. In some cases the wire passages do not extend through the toggle, but instead terminate within the toggle. Accordingly, wires can be inserted into the wire passages up to the interior end of the passage. Thus, in these cases, the wires do not extend out the opposite end of the toggle, and do not need further trimming after termination, like in other jack designs.

According to various embodiments, the body of a toggle also defines multiple terminal channels that are configured to receive electrical terminals of the jack. Pivoting the toggle from an open position to a closed position causes the electrical terminals to enter and/or advance into the terminal channels in the toggle body. Each of the terminal channels intersects a corresponding wire passage. Closing the toggle guides each of the terminals through corresponding terminal channels and eventually through a section of a corresponding wire passage to terminate a wire located in the passage.

Various embodiments provide one or more toggles that include a window, opening, or other aperture for viewing the end of the wire passages within the toggle. According to some embodiments, a viewing aperture is in communication with the ends of one or more wire passages terminating within the toggle. As wires are inserted into the passages, a person can look through a viewing aperture to see one or more of the ends of the wires reach the interior end of the wire passages within the toggle. Such viewing apertures can help a person know whether wires have been fully inserted into the wire passages. This in turn can help ensure that wires have been inserted into the wire passages past an intersection with a corresponding terminal channel, thus facilitating a better connection with electrical terminals as the toggle is closed.

In various implementations, a viewing aperture can be in communication with one, two, or more wire passages. In some cases a toggle includes enough viewing apertures to be able to see the insertion of wires into each of the toggle's wire passages. Various embodiments include a toggle with four wire passages and two viewing apertures, each viewing aperture being in communication with two of the four passages.

In various implementations, a viewing aperture is in communication with a side of a wire passage near or at the interior end of the passage. As an example, the viewing aperture may open into a side of a wire passage near the interior end of the passage. In some cases a viewing aperture may open into the sides of multiple wire passages (e.g., two or more wire passages). According to various implementations, the viewing aperture may extend perpendicular to the longitudinal axis of the wire passage. The viewing aperture can also intersect the side of the wire passage at angles other than 90 degrees in various embodiments.

Various embodiments of the teachings herein provide a jack that is configured as a modular jack. In these cases the jack includes a latch mechanism that allows the jack to be attached to a mounting plate. For example, the latch mechanism may include a resilient tab, a snapping portion, a detent, or some other structure that cooperates with a portion of the mounting plate to attach the jack to the plate. In various implementations, a jack is provided with a keystone configuration, allowing the jack to be snapped into any suitable keystone mounting plate or other base structure. Jacks provided according to the teachings herein may also be configured according to other suitable modular mounting standards and schemes.

According to some embodiments, a jack is provided with an integral mounting plate that can be used to mount the jack to a wall or other desirable support. In such cases, at least a portion of the jack housing is integrally formed with the mounting plate. In some cases the mounting plate and part or the entire jack housing may be integrally cast with a suitable material using an injection molding process. According to various embodiments, the jack may be manufactured from one or more of the following materials: acrylonitrile butadiene styrene (ABS), Polycarbonate (PC), a blend of PC and ABS, and polyvinyl chloride (PVC). Additionally or alternatively, many other known polymeric materials (e.g., such as one or more plastics) may be used in various embodiments. Other known methods of manufacture may also be used. The integration of the mounting plate with the jack can provide the mounting plate with a smooth, unjointed finish.

In various embodiments, a jack is provided as a single assembly of connected parts. As a result, some embodiments do not have loose, unconnected pieces such as a removable load bar. For example, some embodiments use one or more toggles that are pivotally coupled to the jack. These connected parts are thus less likely to be misplaced or lost than separate pieces included with other jacks.

According to some embodiments, a jack may include two or more coupled housing portions. In some cases a housing has a terminal portion (e.g., for terminating cable wires) that is removably or nonremovably coupled to a connection portion (e.g., with a plug opening for receiving a cable plug). According to some arrangements, a terminal portion includes two halves. In some cases the halves have identical configurations and are coupled to each other in a mirrored arrangement. According to some embodiments, a first toggle is pivotally coupled to one of the halves and an identical second toggle is pivotally coupled to the second of the halves.

In some cases a jack includes symmetrically arranged toggles for terminating twisted pair wires. For example, in some configurations a jack has a terminal support and two toggles pivotally coupled on opposite sides of the terminal support. When in closed positions, the toggles are positioned in a generally parallel arrangement, adjacent to opposite sides of the terminal support. The toggles can be pivoted away from the terminal support and each other into respective open positions. According to some embodiments, this type of configuration provides a compact arrangement for a jack with two toggles. In some cases the combined height and width of the two toggles in the closed positions is less than a maximum height and/or maximum width of the jack. As an example, in some cases latching mechanisms on the jack (e.g., for attaching the jack to a mounting plate) may set an overall height and/or width for the jack that is greater than the corresponding height and width of the closed toggles.

Various embodiments include electrical terminals extending from a terminal support. The terminals engage one or more toggles that are pivotally coupled to a jack. In some cases electrical terminals extend from a first side of a terminal support to engage a toggle pivotally coupled on the first side of the terminal support. Additional electrical terminals extend from a second side of the terminal support to engage another toggle pivotally coupled on the second side. In some cases the electrical terminals are configured as IDC terminals. Various implementations provide a circuit board within the terminal support that is coupled to the terminals on each side of the terminal support. For example, in some cases first and second sets of terminals are connected to a circuit board. The first set of terminals extends outward from a first side of a circuit board and the second set of terminals extends out from a second side of the circuit board, opposite the first side and the first set of terminals.

Selected embodiments will now be described with respect to the drawings. These examples are intended to be representative of specific embodiments, but are not intended as limiting the overall scope of embodiments herein.

Figure 2:
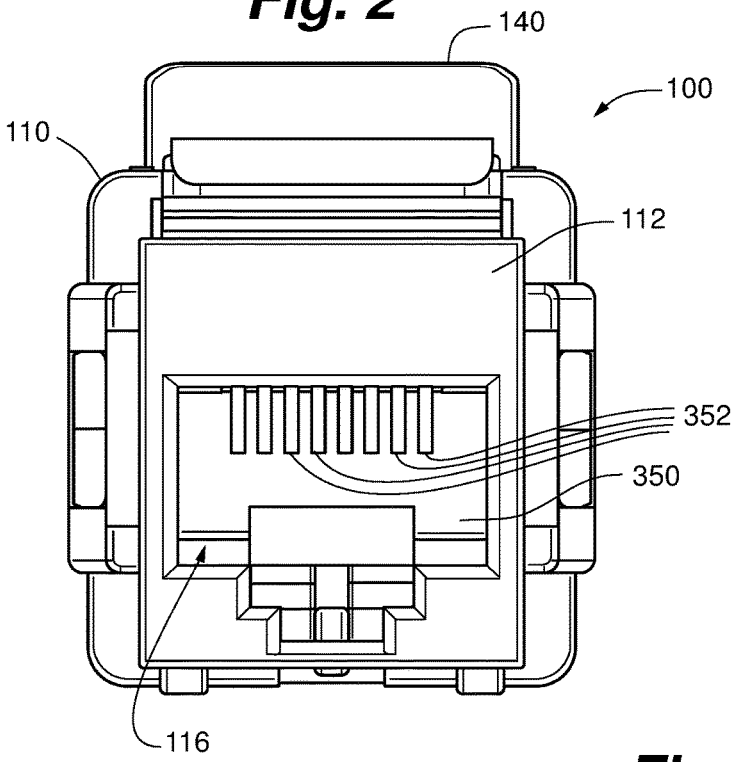
FIG. 2 is a front elevation view of the jack of FIG. 1.
Figure 3:
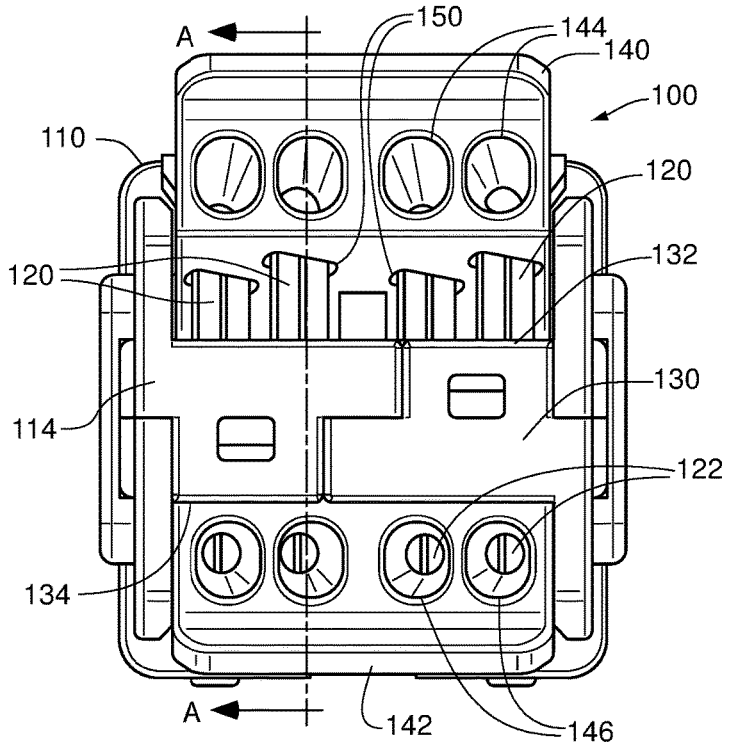
FIG. 3 is a rear elevation view of the jack of FIG. 1.
Figure 6:
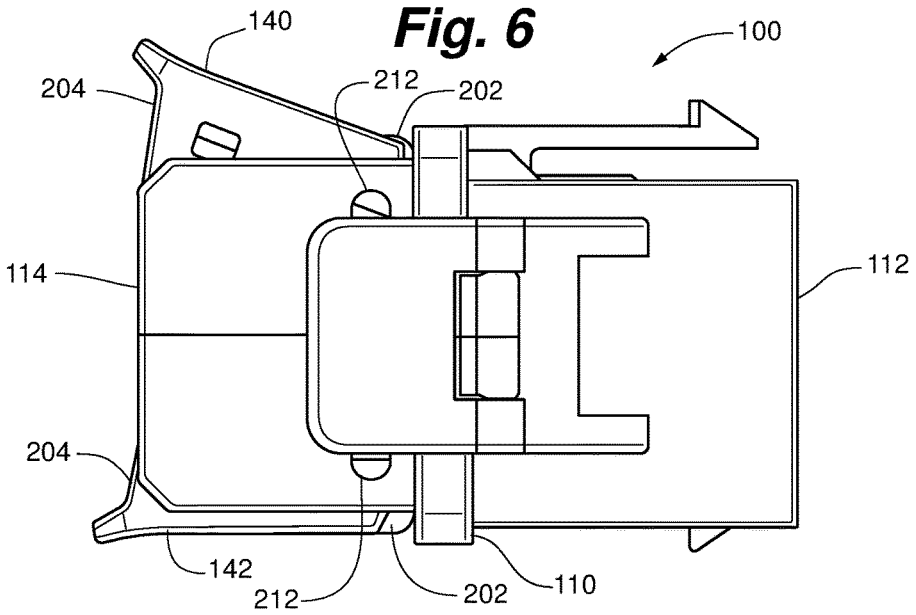
FIG. 6 is a side elevation view of the jack of FIG. 1.
Figure 7:
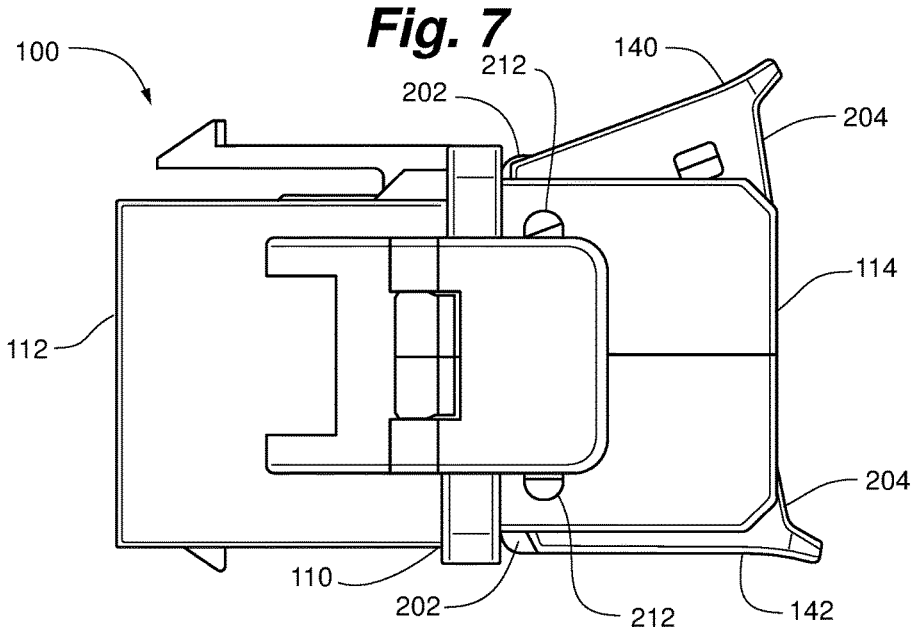
FIG. 7 is another side elevation view of the jack of FIG. 1.
Figure 8:
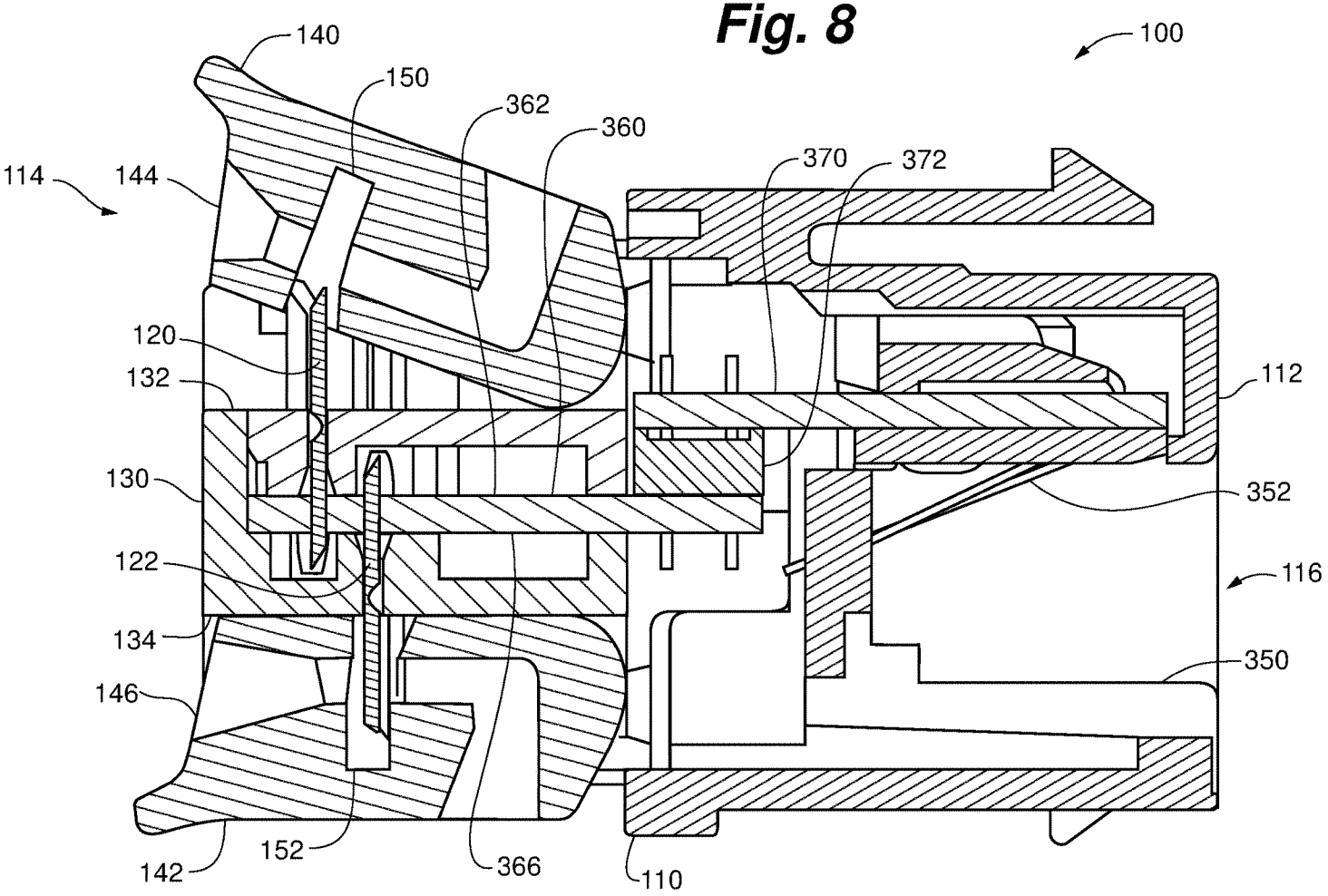
FIG. 8 is a sectional view of the jack in FIG. 3 taken along line AA.

FIGS. 1-8 are views of a communications jack 100 according to various implementations. As depicted in the figures, the jack 100 has a housing 110 with a connection end 112 at one end and a termination end 114 located opposite and facing away from the connection end 112. The connection end 112 has a plug opening 116 that is configured to receive a communications cable connector plug. The illustrated jack 100 has multiple electrical terminals for terminating the wires within a communications cable. As shown in FIGS. 1, 3, and 8, the electrical terminals in this embodiment include a set of first side terminals 120 and a set of second side terminals 122. According to various embodiments, the first and second side terminals 120, 122 are IDC terminals, as depicted in the figures. It should be appreciated that other types of terminals may also be used in some cases.

The first and second side terminals 120, 122 are supported by a terminal support 130. In this and various other embodiments, the first side terminals 120 extend out from a first side 132 of the terminal support 130 and the second side terminals 122 extend out from a second side 134 of the terminal support 130. The illustrated jack 100 includes two toggles configured to connect or terminate the wires of a communications cable to the first and second side terminals 120, 122. A first toggle 140 is located adjacent the first side 132 of the terminal support 130. A second toggle 142 is located adjacent to a second side 134 of the terminal support 130.

According to various embodiments, the two (or more or less, if applicable) toggles each include a number of passages for receiving the wires in a communications cable. As shown in FIGS. 1 and 3, for example, the first toggle 140 in this embodiment includes multiple first wire passages 144 and the second toggle 142 includes multiple second wire passages 146. According to various embodiments, each of a jack's toggles also includes terminal channels in communication with the wire passages. The terminal channels are configured to receive electrical terminals for terminating wires within the wire passages. As one example, FIGS. 3 and 8 illustrate first terminal channels 150 extending into the first toggle 140 and second terminal channels 152 extending into the second toggle 142.

As shown in FIGS. 1-8, in various embodiments the two toggles 140, 142 are pivotally coupled to the jack's housing 110 on opposite sites of the terminal support 130. Referring to FIG. 8, the terminal channels 150, 152 are configured to receive corresponding ones of the electrical terminals 120, 122 as the toggles 140, 142 are pivoted toward the terminal support 130. Pivoting the toggles 140, 142 toward the terminal support 130 thus moves wires located within the wire passages 144, 146 into contact with the first side and second side terminals 120, 122, respectively. A person can thus easily insert cable wires into the toggles' wire passages 144, 146 and terminate the wires within the terminals 120, 122 by rotating the toggles 140, 142 toward the terminal support 130.

According to various embodiments, a communications jack includes multiple toggles of the same design. As just one example, the second toggle 142 depicted in FIGS. 1-8 has the same design as the first toggle 140. The first and second toggles 140, 142 are also arranged in a mirrored or symmetrical arrangement about the terminal support 130 in the depicted implementation. Of course it should be appreciated that various embodiments of a communications jack may include toggles that are different from one another and/or that are arranged differently than the example shown in the figures.

Figure 9:
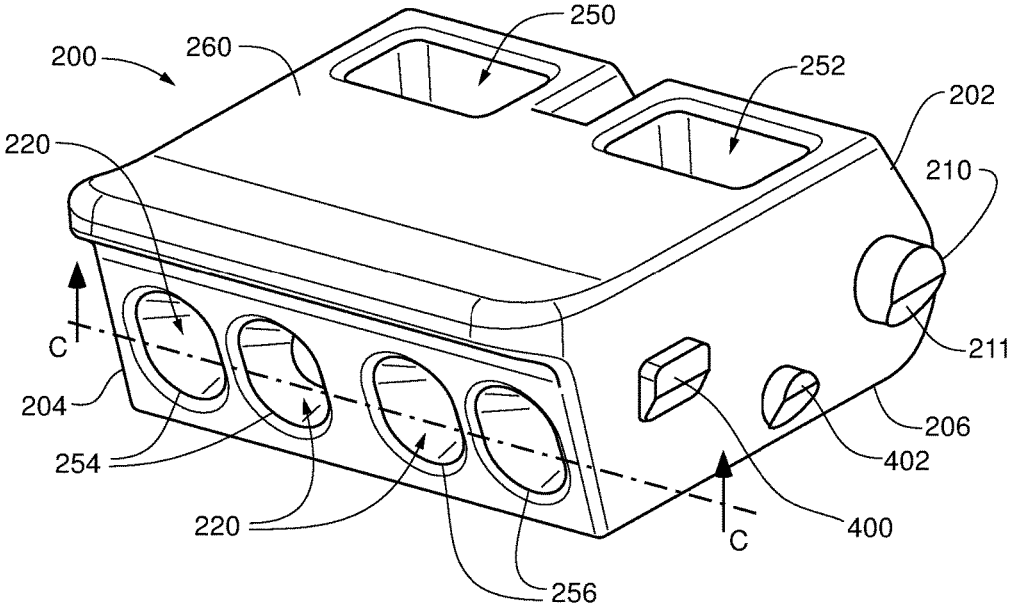
FIG. 9 is a perspective view of a jack toggle according to various embodiments.
Figure 10:
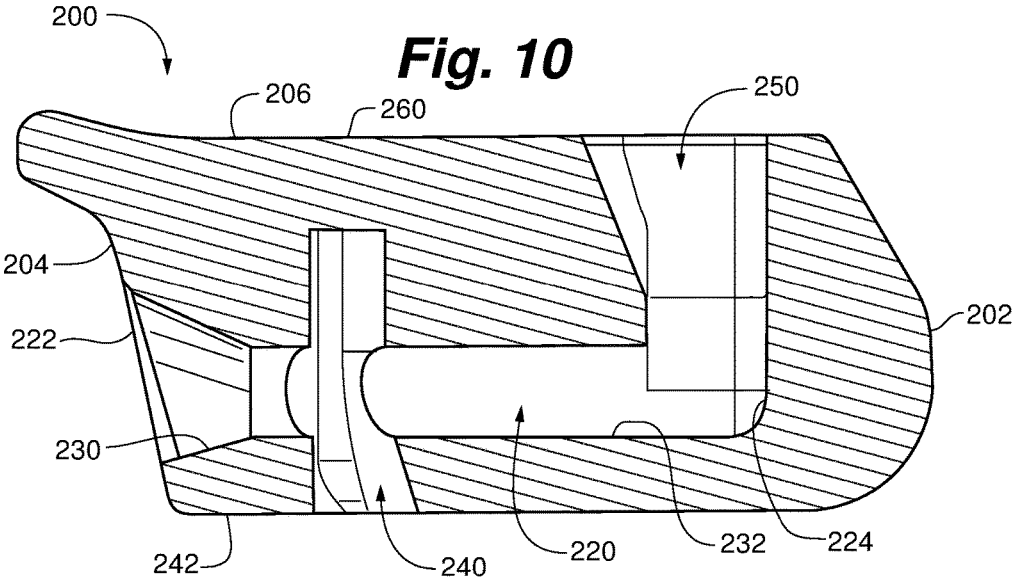
FIG. 10 is sectional view of the toggle of FIG. 9 taken along line BB in FIG. 11.
Figure 11:
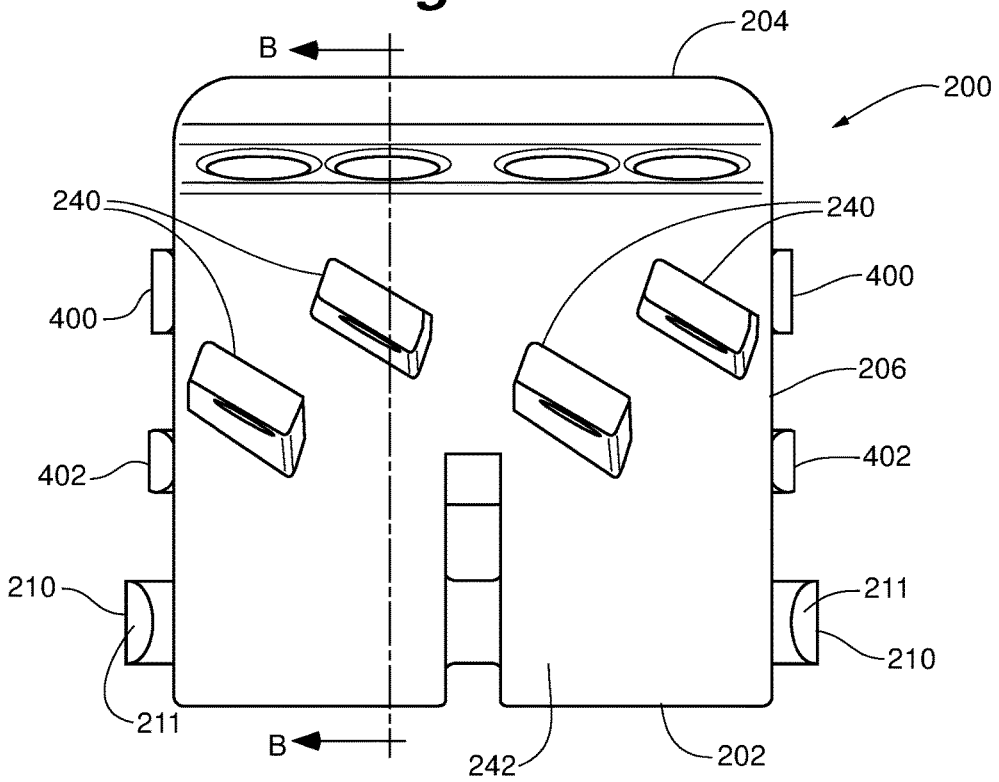
FIG. 11 is a bottom plan view of the toggle of FIG. 9.

FIGS. 9-12 are detailed views of a toggle 200 having the same design as the first and second toggles 140, 142 depicted in the example in FIGS. 1-8. According to various implementations, the toggle 200 has a pivot end 202, an insertion end 204, and a body 206 extending between the pivot end 202 and the insertion end 204. As shown in FIGS. 9-11, in this example the insertion end 204 is generally opposite from the pivot end 202. According to some implementations, the body 206 is generally formed as a single integral piece. In some cases, the body 206 is formed through a suitable manufacturing process such as, for example, injection molding. According to some embodiments, the body 206 is formed from one or more of the following materials: acrylonitrile butadiene styrene (ABS), Polycarbonate (PC), a blend of PC and ABS, and polyvinyl chloride (PVC). Additionally or alternatively, many other known polymeric materials (e.g., such as one or more plastics) may be used to make the body 206 in various embodiments.

The pivot end 202 of the toggle 200 is configured to be pivotally coupled to the housing of a communications jack, such as the jack 100 shown in FIGS. 1-8. In one possible implementation, the toggle 200 includes two pivot posts 210 located at or near the pivot end 202 of the toggle 200. The pivot posts 210 fit within corresponding openings 212 shown in the jack housing 110 in FIGS. 1, 6, and 7.

Alternatively, the housing 110 could include similar posts that pivotally couple with corresponding openings in the toggle body 206. Other suitable pivot mechanisms may be used in various embodiments, including but not limited to, an axle that extends through portions of the jack housing and the toggle body. In some embodiments the pivot posts 210 include an angled surface 211 that can aid in coupling the toggle to a housing by forcing the walls of the housing apart as the toggle is put in place.

According to some embodiments, the pivot end 202 of the toggle 200 is pivotally coupled to the housing of a jack between the jack's connection end and termination end. Referring to FIGS. 6 and 7, for example, the pivot ends 202 of the toggles 140, 142 are both pivotally coupled to the jack housing 110 between the jack's connection end 112 and termination end 114. This arrangement positions the toggles 140, 142 with their pivot ends 202 facing the connection end 112 of the jack 100, and with their insertion ends 204 facing away from the connection end 112 and the plug opening 116 in the connection end 112. In various embodiments the first and second toggles 140, 142 are also positioned relative to the jack housing 110 so that the insertion ends 204 of the toggles are located proximate (e.g., near/next to or at) the termination end 114 of the housing 110.

As previously discussed, in some embodiments a toggle has multiple separate wire passages that are configured to receive and terminate individual wires from a communications cable. Returning to FIGS. 9-12, the toggle body 206 in the illustrated embodiment has four wire passages 220 analogous to the first and second wire passages 144, 146 shown in FIGS. 1-8. Various embodiments may have more or less than four passages. As shown in the sectional views of FIGS. 10 and 12, the wire passages 220 extend from the insertion end 204 of the toggle into the toggle body 206.

According to some embodiments, the wire passages are separately formed within the toggle body. In some cases the body of a toggle defines side walls that extend between adjacent wire passages, thus separating the passages from one another. In the example shown in FIGS. 9-12, the wire passages 220 extend into and within the interior of the toggle body 206 from a first end 222 at the insertion end 204 of the toggle to a second end 224 located within the toggle body 206. The wire passages 220 thus extend into the body 206 of the toggle 200, which encompasses the wire passages 220 and defines the side walls of the wire passages 220.

Figure 12:
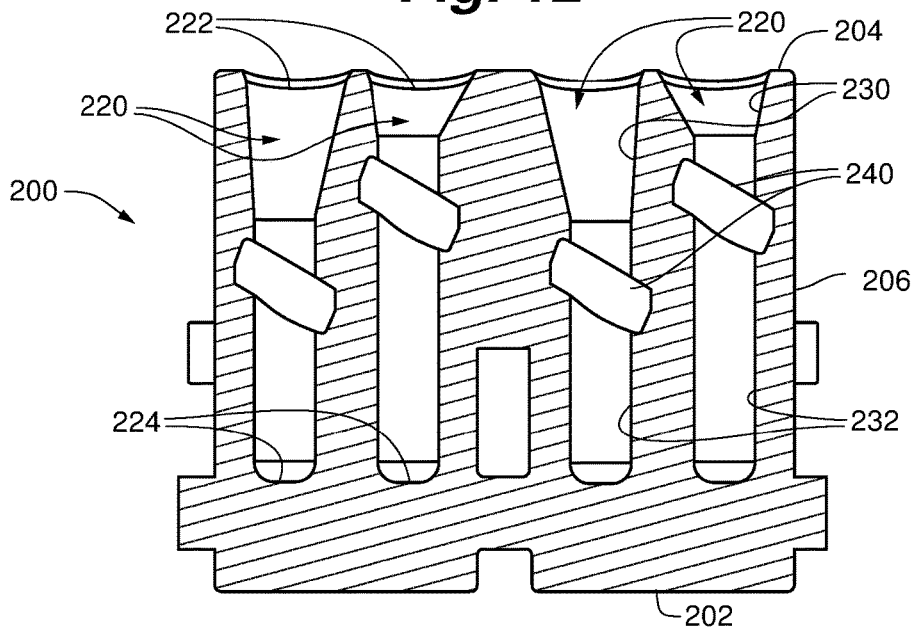
FIG. 12 is a sectional view of the toggle of FIG. 9 taken along line CC in FIG. 9.

In some implementations, the wire passages in a toggle can include one or more features that help ease the insertion of wires therein. Continuing with reference to FIGS. 10 and 12, for example, in some cases one or more of the wire passages 220 extend straight into the toggle body 206 along respective longitudinal axes. The wire passages 220 in this example also include a funnel portion 230 that feeds into a straight portion 232 of the passages. As shown in FIGS. 10 and 12, the funnel portion 230 in this example is located at the first end 222 of each passage 220 and the straight portion 232 extends between the funnel portion 230 and the second end 224 of each wire passage. According to various embodiments, this configuration of the wire passages enables each wire passage 220 to receive (e.g., fully receive) an end of a wire in a single insertion motion.

As discussed above with respect to FIGS. 1-8, each of the first and second toggles 140, 142 include multiple terminal channels that are configured to receive the terminals 120, 122 extending from the terminal support 130. Turning to FIGS. 10-12, the toggle 200 has four terminal channels 240 that extend into the toggle body 206 from a bottom side 242 of the toggle 200 (as viewed in FIGS. 10-12). Each of the terminal channels 240 intersects a corresponding one of the wire passages 220, thus enabling an electrical terminal to be inserted into the corresponding wire passage 220 and into contact with a wire located therein. As shown in FIG. 11, in various embodiments the terminal channels 240 are staggered across the bottom side 242 of the toggle and/or angled, which can be helpful for increasing electrical isolation between the terminals and wire passages.

According to various embodiments, each toggle in a jack can pivot between an open position, in which wires can be inserted into the toggle, and a closed position, in which the wires are terminated within electrical terminals of the jack. Turning back to FIG. 8, the first toggle 140 is shown in an open position rotated away from the terminal support 130 and the second toggle 142 is shown in a closed position, rotated toward the terminal support 130. As the first toggle 140 is pivoted from the open position to the closed position, the toggle 140 engages the first terminals 120 within the first terminal channels 150. As the toggle 140 continues to pivot closed, each of the terminal channels 150 guides one of the first side terminals 120 through a section of one of the first wire passages 144 in order to terminate a wire therein.

As previously discussed, various implementations of a communications jack include one or more windows, openings, or other apertures for viewing the insertion of wires into the end of a toggle's wire passages. Returning to FIGS. 9-10, in this embodiment the toggle 200 has a first viewing aperture 250 and a second viewing aperture 252. According to this embodiment, the first viewing aperture 250 is in communication with a first pair 254 of wire passages 220 and the second viewing aperture 252 is in communication with a second pair 256 of wire passages 220. Thus, each of the viewing apertures 250, 252 provides a window for viewing two of the wire passages 220, which can be helpful when determining whether wires have been fully inserted into the passages 220.

Viewing apertures may communicate with various portions of one or more wire passages within a jack toggle. According to some implementations, such as the examples in the figures, the viewing apertures are configured to communicate with the ends of one or more wire passages. The sectional view in FIG. 10 illustrates, for example, that the viewing aperture 250 is in communication with and opens into the wire passage 220 at or near the second end 224 of the wire passage 220. In this example the viewing aperture 250 opens into an upper half (as viewing in FIG. 10) of the wire passage 220. Accordingly, the second end 224 of the wire passage 220 still provides a stopping point for wire insertion. In addition, the side walls of the wire passage 220 still define a separate space for the wire passage as shown in the sectional view in FIG. 12.

Figure 4:
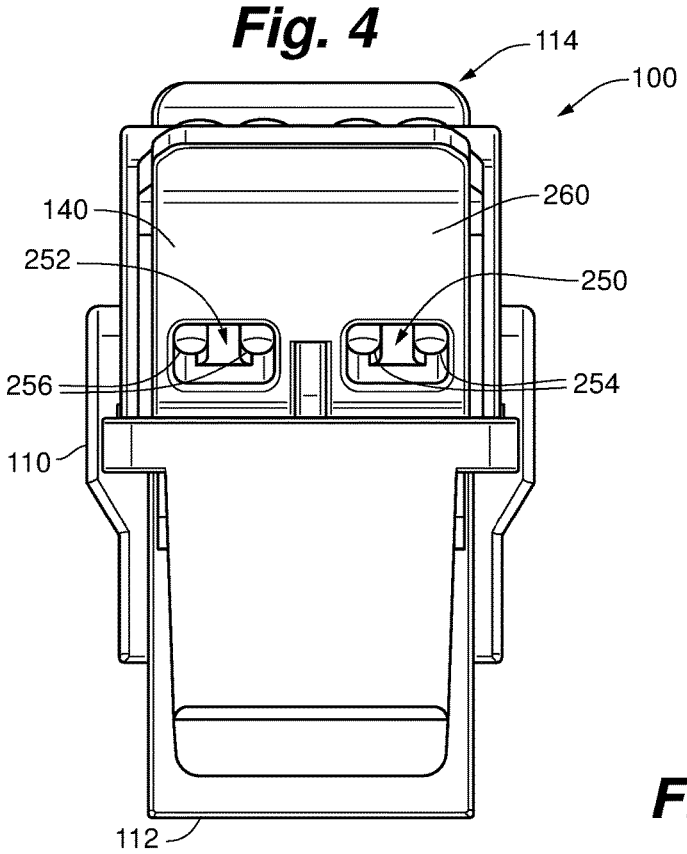
FIG. 4 is a top plan view of the jack of FIG. 1.
Figure 5:
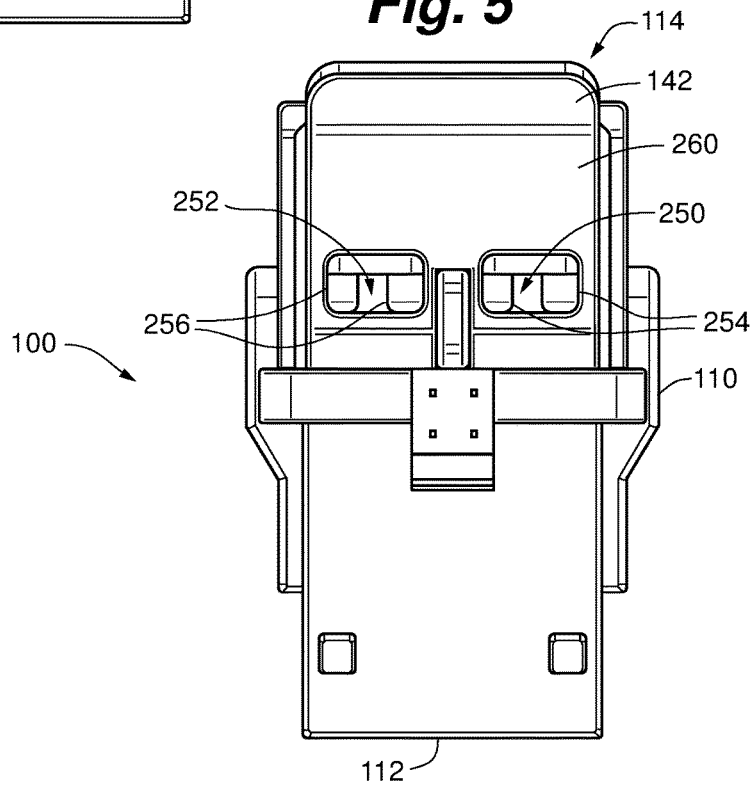
FIG. 5 is a bottom plan view of the jack of FIG. 1.

Returning to FIGS. 9-10, the viewing apertures 250, 252 extend into the body 206 of the toggle 200 from a top side 260 of the toggle 200 (as oriented in FIGS. 9-10), which is accessible and visible to a person inserting wires into the wire passages. Turning to FIGS. 4-5, each of the toggles 140, 142 also include first and second viewing apertures 250, 252 in communication with first and second pairs 254, 256 of wire passages. As with the example in FIGS. 9-10, the viewing apertures 250, 252 extend into the toggles 140, 142 from an exterior side 260 of the toggles.

FIGS. 4-5 also illustrate how the viewing apertures 250, 252 are in communication with the interior ends of the wire passages. As is shown, the first viewing aperture 250 provides a view of the interior ends of a first pair 254 of wire passages, while the second viewing aperture 252 provides a view of the interior ends of a second pair 256 of wire passages. The viewing apertures thus enable a person to see whether wires have been fully inserted (e.g., inserted to the end of each passage) into each wire passage. At the same time, the wire passages are still separately defined within the toggle, thus making it easier to fully insert the wires without, e.g., wires getting hung up or inadvertently crossing into an adjacent wire passage.

A jack toggle can include different numbers of viewing apertures depending up the desired configuration and space available. As shown in the figures, in some implementations each viewing aperture is in communication with the second, interior end of two adjacent and separate wire passages. This arrangement can be helpful in some cases as it allows a person to simultaneously insert at least two wires (e.g., the two wires of a twisted pair) into adjacent wire passages and determine whether they have been fully inserted. With the implementations shown in FIGS. 1-8 and 9-12, a person can optionally simultaneously insert four wires (e.g., the four combined wires from two twisted pair) into the four wire passages in the toggle and also see through the viewing apertures 250, 252 when the wires have been fully inserted.

Figure 13:
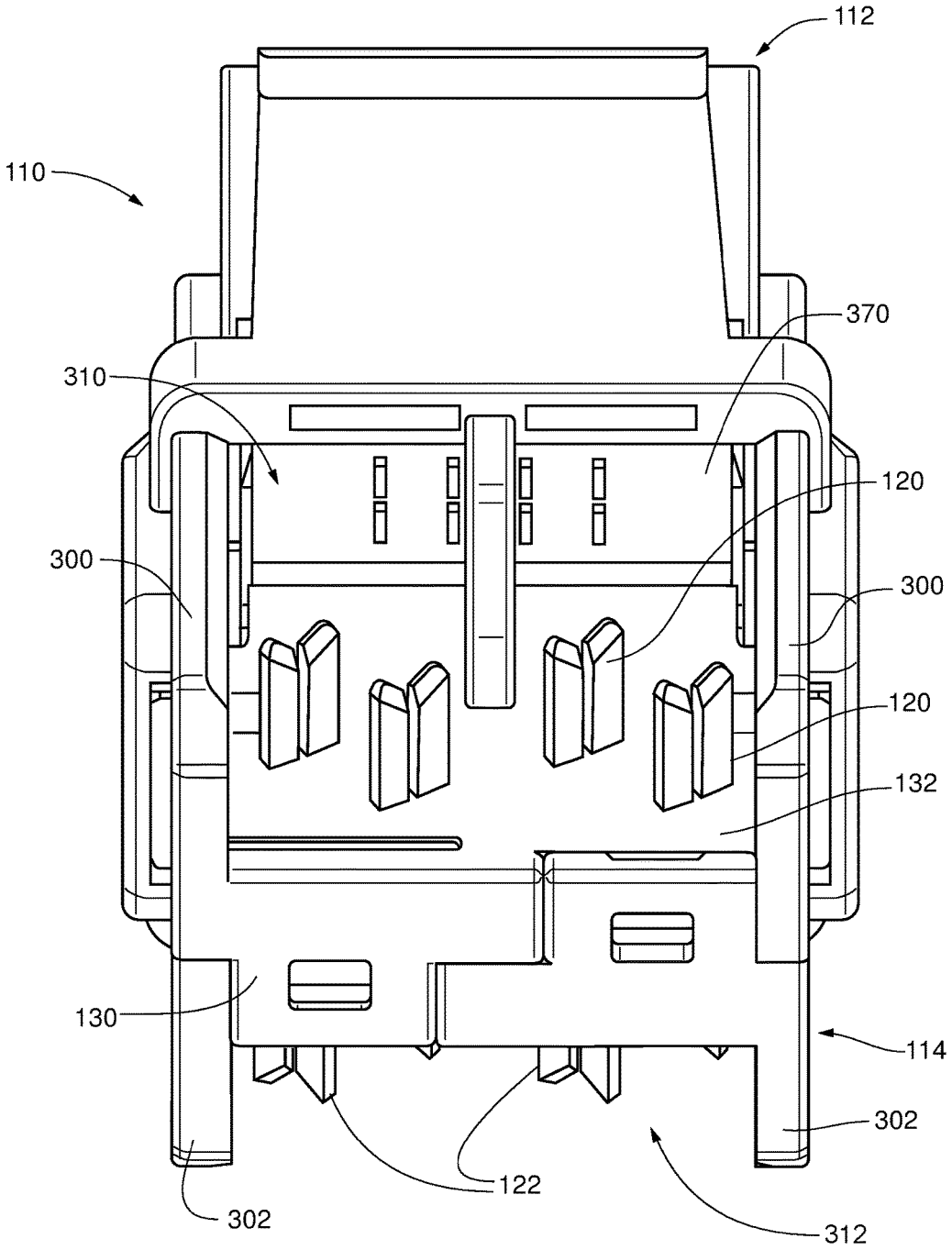
FIG. 13 is a rear perspective view of a housing and electrical terminals of the jack of FIG. 1 according to various embodiments.
Figure 14:
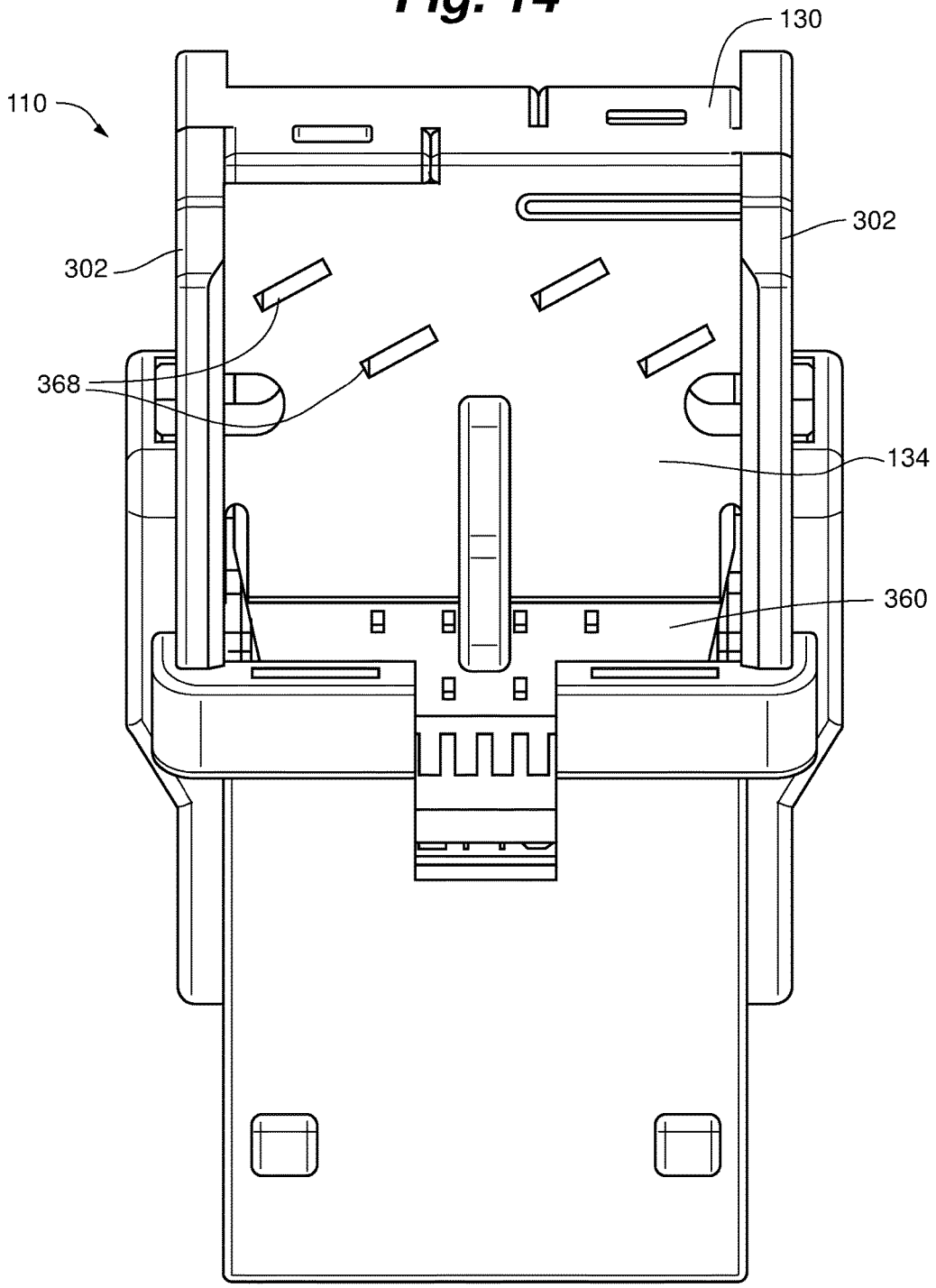
FIG. 14 is a rear perspective view of the housing of FIG. 13 without electrical terminals.
Figure 15:
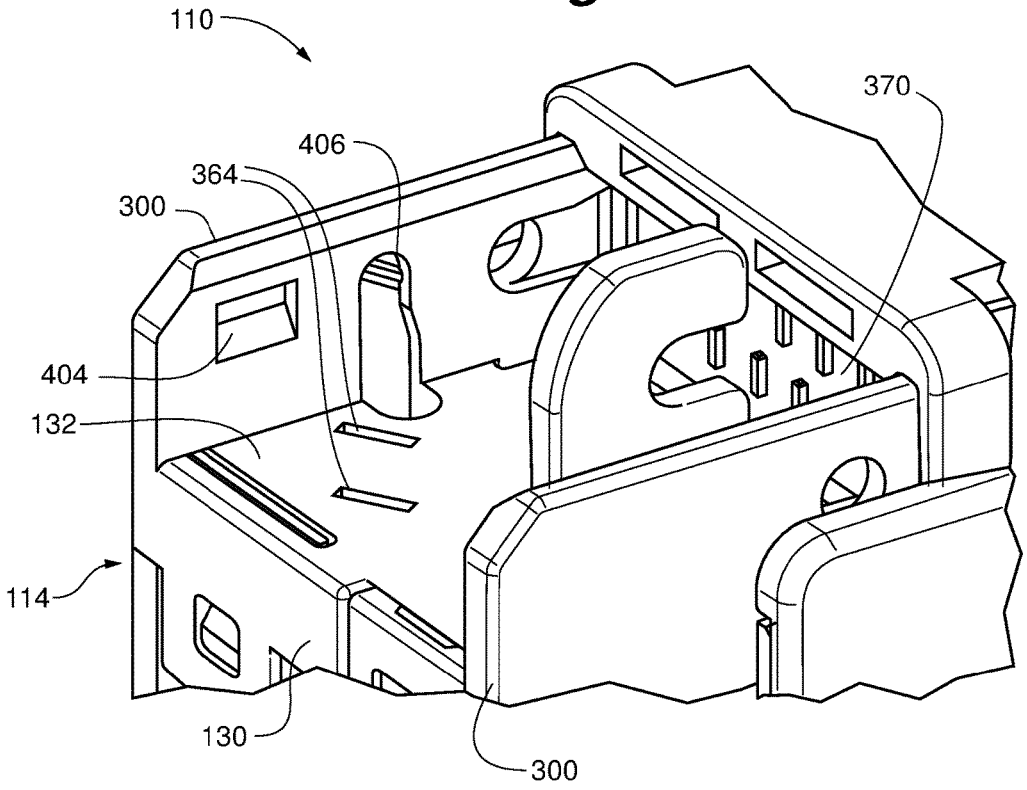
FIG. 15 is a partial perspective view of the housing of FIG. 13 without electrical terminals.

FIGS. 13-15 provide various views of the housing 110 of the jack 100 depicted in FIGS. 1-8. According to various embodiments, the jack housing 110 includes first side walls 300 configured to pivotally couple with the first toggle 140. The housing 110 in this implementation also includes second side walls 302 that can pivotally couple with the second toggle 142 depicted in FIG. 1. In addition, the housing 110 includes a terminal support 130, which is also shown in FIGS. 1-8 according to various embodiments. The housing 110 also provides the connection end 112 of the jack 100 shown in FIG. 2, and the termination end 114 shown in FIG. 3.

In the illustrated embodiment, the first side walls 300 extend on the first side 132 of the terminal support 130, while the second side walls 302 extend out on the second side 134 of the terminal support 130, opposite from the first side walls 300. According to various embodiments, the first side walls 300 and the first side 132 of the terminal support 130 provide a first termination bay 310 that is configured to receive the first toggle 140 as it rotates toward the terminal support into a closed position. Likewise, the second side walls 302 and second side 134 of the terminal support provide a second termination bay 312. The first side and second side terminals extend out of the terminal support into the termination bays, and thus engage the toggles when the toggles are pivoted into the closed positions.

FIG. 2 provides a front view of the connection end 112 of the housing 110. The connection end 112 has a plug opening 116 that leads into a plug receptacle 350 within the jack housing 110. The plug opening 116 and receptacle 350 are configured to receive and terminate a matching connector plug coupled to a communications cable. As shown in FIG. 2, for example, the receptacle 350 includes a number of spring contacts 352 within the plug receptacle 350 that are configured to electrically terminate a cable plug. According to various embodiments, the plug opening 116 and the receptacle 350 in this example have an 8 position, 8 contact (8P8C) modular connector configuration, which may also be referred to as an RJ45 connector configuration. Other desirable connector configurations may be implemented in various other embodiments.

As previously discussed, the terminal support 130 includes a first side 132 and a second side 134 that is opposite from and facing away from the first side 132. The first side terminals 120 extend out from the first side 132 of the terminal support 130 for engaging with the first toggle 140. Similarly, the second side terminals 122 extend out from the second side 134 of the terminal support 130 to engage with the second toggle 142. According to some implementations, the first side terminals 120 and the second side terminals 122 are electrically coupled to the spring contacts 354 within the plug receptacle 350.

According to various embodiments, the first and second side terminals 120, 122 are coupled to the spring contacts 352 via conduction paths extending through one or more circuit boards. Turning to FIG. 8, for example, the first and second side terminals 120, 122 are connected to a terminal circuit board 360 extending within the jack housing 110. In this case the first side terminals 120 extend out from a first side 362 of the circuit board 360 and then through openings 364 in the first side 132 of the terminal support 130 shown in FIG. 15. In a similar manner, the second side terminals 122 extend out from a second side 366 of the circuit board 360. The second side terminals then extend through openings 368 in the second side 134 of the terminal support 130, shown in FIG. 14.

As shown in FIG. 8, in some embodiments the terminal circuit board 360 is electrically coupled to a connector circuit board 370, which in turn is electrically coupled with the spring contacts 352. According to some embodiments, the terminal and connector circuit boards 360, 370 are electrically coupled together via a connection member 372, though other configurations are also possible.

According to various embodiments, a jack's terminal support is generally located between the termination and connection ends of the jack. In various embodiments the terminal support extends from the termination end toward the connection end. As shown in FIG. 8, the depicted terminal support 130 extends from the termination end 114 toward the connection end 112 and then stops roughly midway to the connection end 112. As will be discussed, in some cases a terminal support may be provided by a terminal portion of the jack housing. In some such embodiments, the terminal support may not extend into a connector portion of the housing.

As previously discussed, the toggles 140, 142 of the jack 100 shown in FIGS. 1-8 can be pivoted or rotated relative to the terminal support 130. According to some embodiments, the toggles 140, 142 are pivotable between an open position and a closed position. FIGS. 1-8 depict the first toggle 140 in an open position, in which the toggle is rotated away from the terminal support 130 to enable the inserting of wires into the toggle's wire passages 144. Referring to FIG. 8, in this implementation the first toggle 140 is considered to be in the open position because while the first side terminals 120 extend partially into the first terminal channels 150, the first side terminals 120 do not intersect and/or block the wire passages 144 so much that wires cannot be loaded therein. In contrast, the second toggle 142 is considered to be in the closed position because the terminals 122 intersect the wire passages 146, thus enabling them to make electrical connection with wires inserted into the passages.

According to various embodiments, a communications jack is provided with one or more catch or detent systems to assist in maintaining toggles in an open and/or closed position. Regarding the implementation in FIGS. 1-8, the jack 100 includes such a catch system for each of the first and second toggles 140, 142. The perspective view of the toggle 200 in FIG. 9 shows part of the detent system provided for the first and second toggles 140, 142 in FIGS. 1-8. In this embodiment, the toggle 200 is provided with first closed detent members 400 and first open detent members 402. The first closed and open detent members engage detent members in corresponding side walls of the jack housing. In this implementation the first closed and open detent members 400, 402 located on the toggle 200 are formed as pegs that selectively interfere with openings and ridges forming the corresponding detent members in the first and second side walls 300, 302.

One possible implementation of the detent members formed in the side walls is shown in FIG. 15. As is depicted, the side wall 300 includes a second closed detent member 404 configured to engage with the first closed detent member 400 on the toggle 200 in order to maintain the toggle 200 in a closed position. The side wall 300 also includes a second open detent member 406 that is configured to engage with the first open detent member 402 in order to maintain the toggle 200 in an open position. Although not illustrated, the other side walls 300, 302 also include second closed and open detent members for engaging corresponding detent members on the first and second toggles.

Accordingly, the catch systems are configured to alternately maintain the toggles in the open and closed positions with cooperating detent members. It should be appreciated that other forms of detents may be used. In addition, detents may be provided on both sides, on just one side of a toggle, and/or may be selectively provided for only some toggles and not others.

Figure 16:
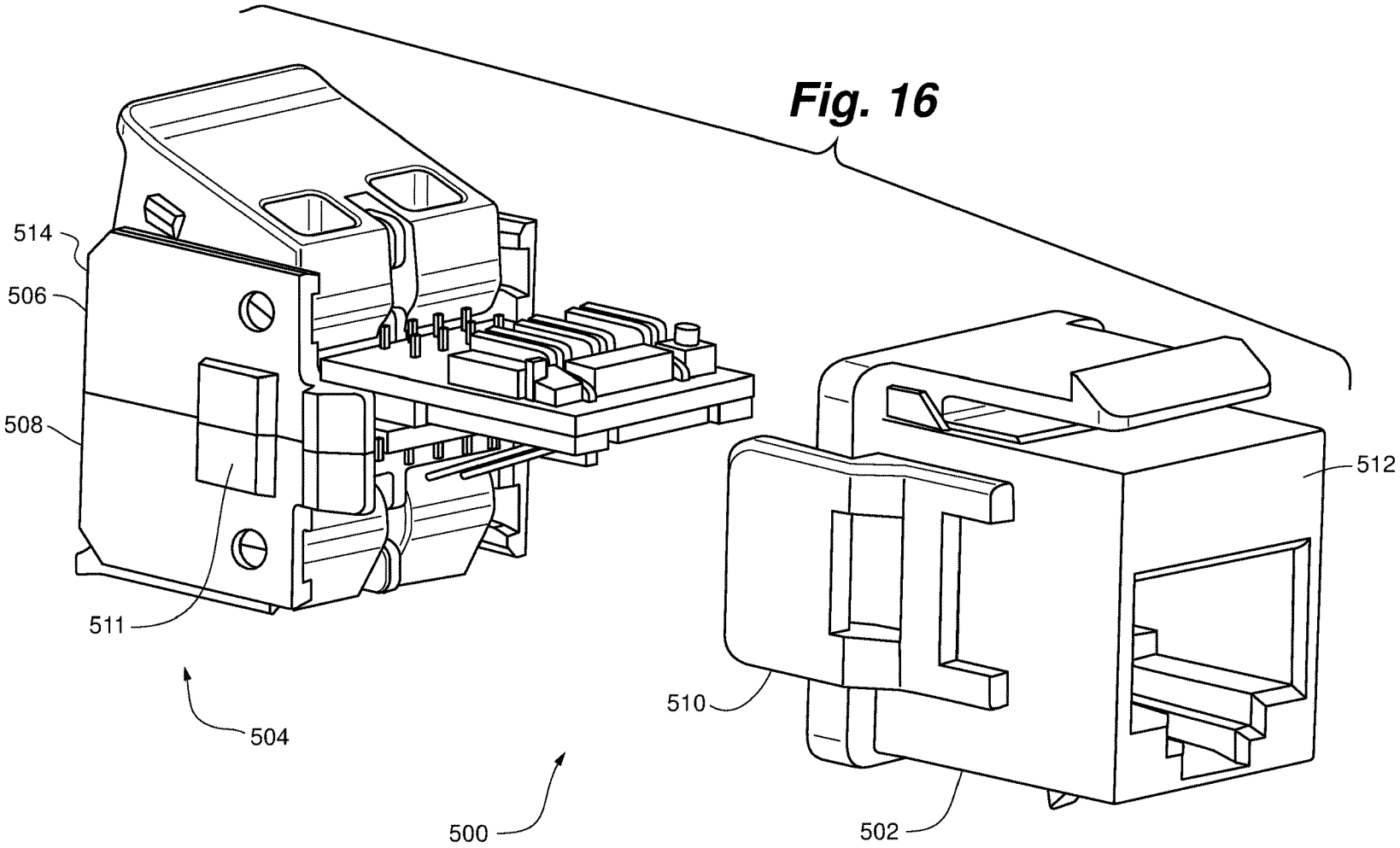
FIG. 16 is an exploded assembly view of a jack according to various embodiments.

According to various embodiments, a communications jack can be provided as an assembly of component parts. Turning to FIG. 16, in some embodiments a communications jack 500 is assembled from a connector portion 502 and a terminal portion 504. In the illustrated example, the terminal portion 504 connects to the connector portion 502 with its termination end 514 located opposite from and facing away from the connection end 512 of the connector portion 502. Thus, in this implementation the termination end is oriented 180° from the connection end. The rearward-facing orientation of the termination end 514 in this example can in some cases make it easier for a person to access the termination end when terminating cable wires.

In the implementation shown in FIG. 16, the connector portion 502 includes latch members 510 that removably couple with corresponding latch members 511 on the terminal portion 504 of the jack housing. In this example the latch members 510 on the connector portion 502 include latch plates with openings configured to receive and catch on the raised areas that make up the latch members 511 on the terminal portion 504. Of course various types of latch mechanisms can be used to couple together the terminal portion 504 and the connector portion 502 in a removable or non-removable manner.

According to various embodiments, a terminal housing portion may be assembled from multiple parts. As shown in FIG. 16, the terminal portion 504 is assembled from two terminal halves 506, 508. Other configurations of constituent parts are also possible. In various embodiments assembly components may be configured to be coupled together in a fixed or non-removable attachment. In some embodiments two or more components may be removably coupled together.

It should be appreciated that the assembly view of the communications jack 500 also shows the component parts that are assembled to form the jack 100 depicted in FIGS. 1-8. Accordingly, in some implementations the housing 110 of the jack 100 is formed by assembling the terminal portion 504 with the connector portion 502 shown in FIG. 16. Returning to FIG. 1, the perspective view of the jack 100 illustrates a possible implementation of assembling a first terminal half 506 with a second terminal half 508 to form the terminal portion 504 of the jack housing 110. As shown in FIG. 1, the first toggle 140 is pivotally coupled to the first terminal half 506 and the second toggle 142 is pivotally coupled to the second terminal half 508.

According to some embodiments, each of the terminal halves 506, 508 has the same design, which in this case is configured so that two halves of the same design can couple together in a mirrored arrangement as shown in FIG. 1. As shown in FIG. 1, each of the terminal halves 506, 508 includes a latch plate 520 that engages a raised portion 522 on the other terminal half when the halves are coupled together. In this embodiment, the first and second terminal halves 506, 508 are removably connected together, though in some cases the halves may be permanently coupled.

Figure 17:
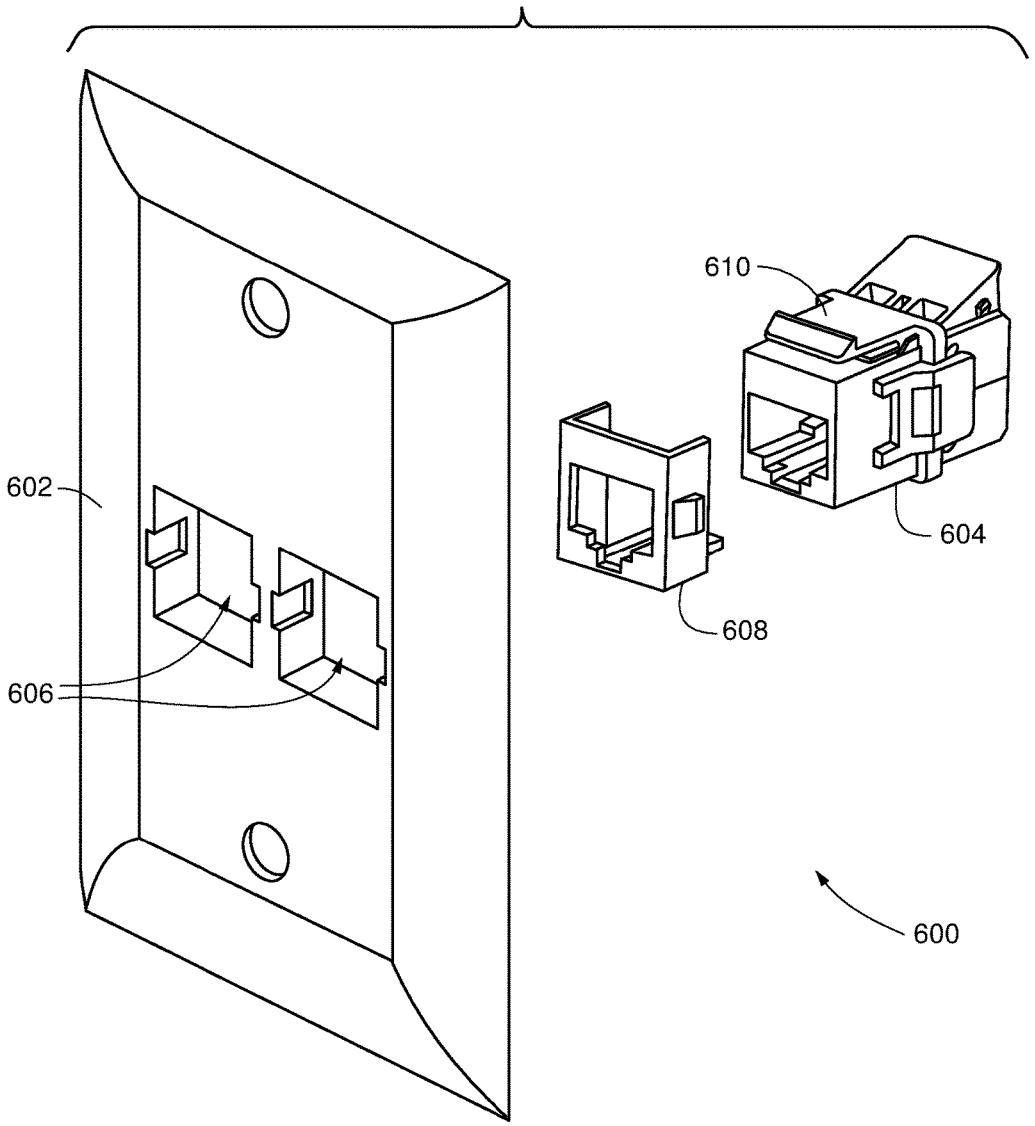
FIG. 17 is an exploded assembly view of a jack system including a mounting plate according to various embodiments.

FIG. 17 is an exploded assembly view of a jack system 600 including a mounting plate 602 according to various embodiments. In this implementation the jack system 600 includes a modular jack 604, which according to various embodiments, is the same as the jack 100 shown in FIG. 1. Returning to FIG. 17, the jack 604 is configured to be inserted into an opening 606 in the mounting plate 602, in this case with an intermediate bezel 608 first inserted into the opening 606. According to some embodiments the jack 604 includes a latch 610 for removably securing the jack 604 within the mounting plate opening 606.

It should be appreciated that a modular jack system such as the system 600 can be provided with a variety of modular latching configurations. According to some embodiments, the jack 604 and the mounting plate 602 have a keystone configuration. In some embodiments the jack 604 and mounting plate 602 utilize a modular configuration present in the surface mount housings and modules sold by Suttle Solutions under the brand SPEEDSTAR™.

Figure 18:
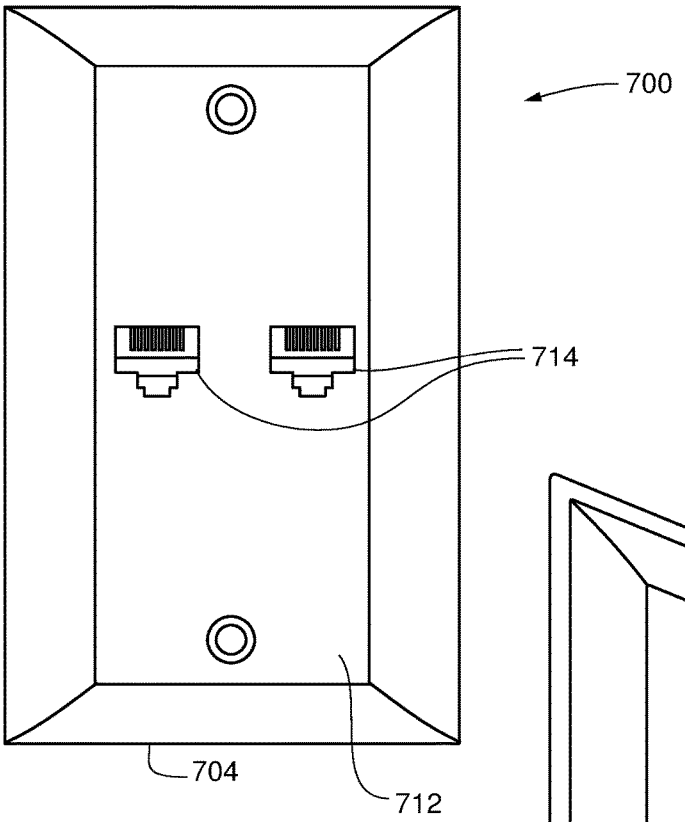
FIG. 18 is a front elevation view of an integrated jack including a mounting plate according to various embodiments.
Figure 19:
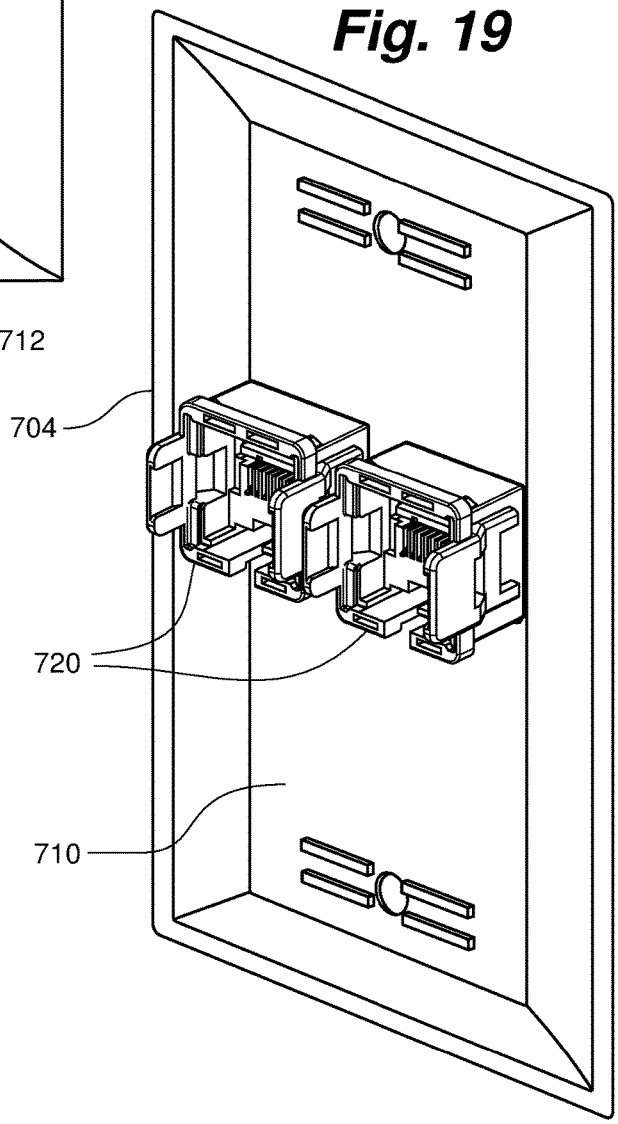
FIG. 19 is a rear perspective view of the integrated jack of FIG. 18 according to various embodiments.
Figure 20:
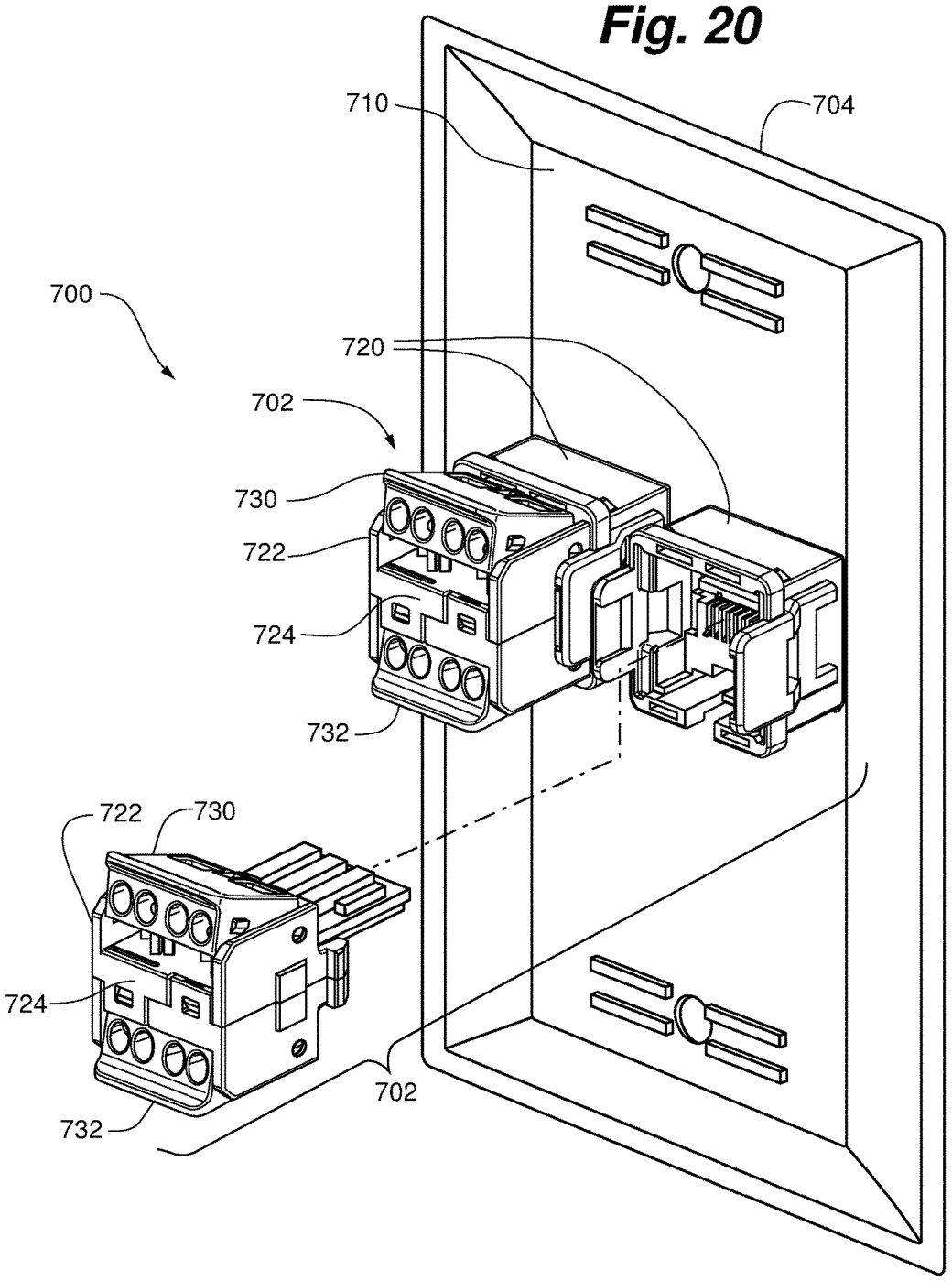
FIG. 20 is an exploded assembly view of the integrated jack of FIG. 18 including corresponding jack terminal portions.

Various implementations of a communications jack can include an integral mounting plate. FIGS. 18-20 are views of an integrated communications jack 700 according to various embodiments. According to this configuration, the integrated jack 700 includes two jack portions 702 that are at least partially attached to a mounting plate 704 in a permanent manner. For example, in some cases part of the jack portions 702 may be integrally formed with the mounting plate 704. According to some embodiments, an injection molding process is used to form the mounting plate 704 with at least part of the jack portions 702 already attached. In some cases one, two, three, or more jack portions 702 may be formed integrally with a mounting plate in a variety of configurations.

According to various embodiments, the integrated jack 700 shown in FIGS. 18-20 includes two jack portions 702 attached to an inner side 710 of the mounting plate 704. The inner side 710 of the mounting plate 704 can, for example, be configured to face a support surface such as a wall, floor, ceiling, or other structural support. An outer side 712 of the mounting plate is opposite the inner side 710 and has two openings 714. The openings 714 are configured to receive a communications connector plug (not shown in FIGS. 18-20) such as, for example, an 8P8C (RJ-45) modular plug, or a plug of any other suitable physical or electrical configuration. The openings 714 extend through the outer and inner sides 712, 710 of the mounting plate into the jack portions 702.

In the implementation depicted in FIGS. 18-20, each jack portion 702 has a housing that includes a connector portion 720 and a terminal portion 722. The connector portion 720 is connected to (e.g., integral to) the mounting plate 704 and has a plug receptacle in communication with an opening 714 in the mounting plate 704. According to various embodiments, the terminal portion 722 has a terminal support 724. As with some embodiments already described herein, the terminal support 724 supports first and second side terminals that extend from opposite first and second sides of the terminal support 724. The terminal portion 722 further has first and second toggles 730, 732 that are pivotally coupled on opposite sides of the terminal support 724 for engaging the first and second side terminals in order to terminate wires inserted into the toggles.

According to various embodiments, the first and second toggles 730, 732 have the same configuration as the first and second toggles 140, 142 of the jack 100 shown in FIGS. 1-8. As an example, each of the toggles 730, 732 includes an insertion end that faces away from the mounting plate. According to various embodiments, each toggle 730, 732 includes a row of four wire passages extending from the insertion end into the toggles. The wire passages are configured so that a twisted pair wire from a communications cable can be introduced into the toggle in a single insertion motion. In some cases more or less than four wire passages may be provided.

As with the implementation of the jack 100, rotating the first and second toggles 730, 732 of the jack portions 702 from an open position to a closed position inserts corresponding terminals into terminal channels defined in the toggles. This engagement guides wires located within the wire passages into the terminals in order to electrically terminate them there. In addition, in some embodiments an integrated jack may includes toggles that incorporate one or more viewing apertures as discussed above. In the example shown in FIGS. 18-20, the first toggle 730 has a first viewing aperture in communication with two of the toggle's wire passages and a second viewing aperture in communication with the other two wire passages in the toggle 730. Although not shown in FIGS. 18-20, the second toggle 732 has a third viewing aperture in communication with two of the second toggle's wire passages, and also has a fourth viewing aperture in communication with the other two wire passages in the second toggle 732. This configuration of four viewing apertures is similar to the arrangement of viewing apertures in the first and second toggles 140, 142 of the jack 100 shown in FIGS. 1-8.

As shown in FIGS. 19-20, in the illustrated embodiment the connector and terminal portions 720, 722 of each jack portion 702 can be removably coupled in the same manner discussed above with respect to FIG. 16. According to various embodiments, the connector and terminal portions may instead be permanently coupled. Other physical configurations and arrangements not illustrated herein are also contemplated.

Turning to FIGS. 21A-21F, some steps in a method for terminating twisted pair wires in a jack will now be described according to various embodiments. Reviewing FIGS. 21A-21F, it should be appreciated that in the depicted implementation, the method steps involve terminating wires in the jack 100 previously described with reference to FIGS. 1-8 and other figures. According to various embodiments the same steps can be performed with other jacks configured according to the teachings herein.

Figure 21A:
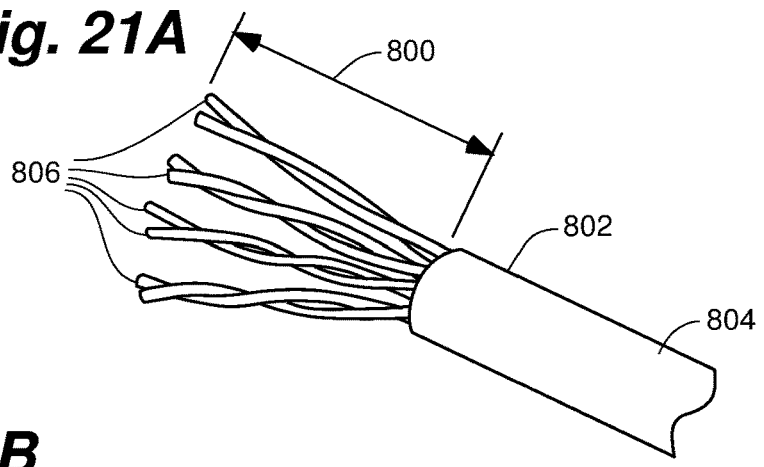
FIGS. 21A-21F depict steps in a method for terminating twisted pair wires in a communications jack according to various embodiments.

In various implementations, methods for terminating communications cable wires using jacks provided according to the teachings herein can provide benefits such as streamlining the termination process. Turning to FIG. 21A, in some embodiments a termination method includes removing a length 800 of cable jacket 802 from an end of a communications cable 804 to reveal multiple pairs of twisted wires 806. In some embodiments the length 800 of removed cable jacket may be at least 30 millimeters. In some cases a smaller length may be possible.

Figure 21B:
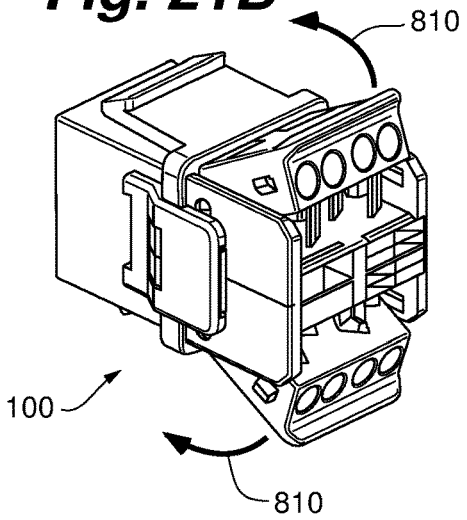
Figure 21C:
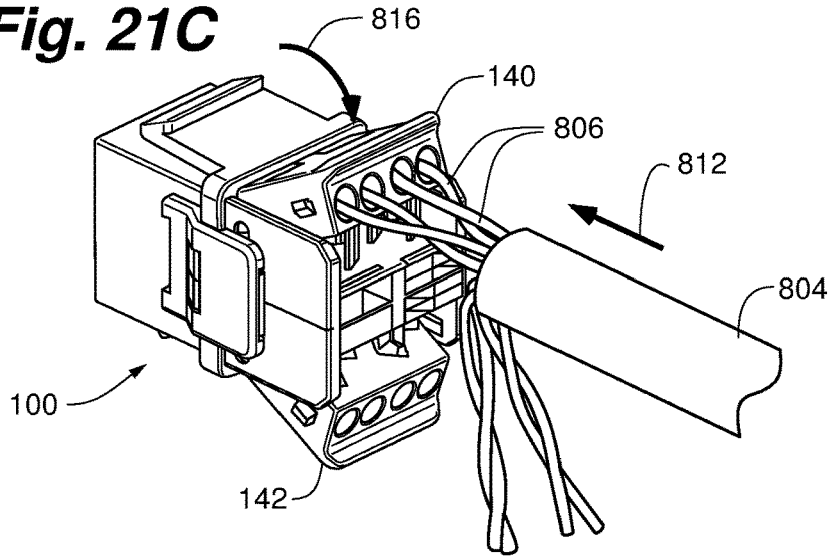

As shown in FIG. 21B, the termination method in this case includes rotating 810 the toggles 140, 142 of the communications jack 100 into their open positions. According to some implementations, this may involve pivoting the toggles to about thirty degrees away from the terminal support. In some cases the amount of rotation may be greater or lesser. In some cases rotating 810 the toggles into the open positions shown in FIG. 21B effectively clears a path through the wire passages extending into the toggles by withdrawing the terminals from the terminal channels in the toggles to some extent.

In various implementations, the termination method also involves separating the pairs of twisted wires 806 and untwisting the ends of each pair of wires 806. After bringing the end of the communications cable 804 near the jack, the method involves inserting 812 the wires 806 into wire passages in two toggles. According to some embodiments, some wires 806 are inserted 812 into a first toggle 140 shown in FIG. 21C, after which the toggle 140 is pressed to pivot 816 the toggle 140 into a closed position. A subsequent step shown in FIG. 21E then involves inserting 812 some of the wires 806 into a second toggle 142, and rotating 816 the second toggle closed. Alternatively, in some cases the wires 806 may be inserted into both toggles 140, 142, and then both toggles may be subsequently pivoted 816 closed. FIG. 21E illustrates this sequence of steps according to one possible implementation.

According to various embodiments, the untwisted ends of at least some wires 806 are inserted 812 into corresponding toggle wire passages in a single motion. In some embodiments at least two wires (e.g., two wires forming one of the pairs of twisted wires) are simultaneously inserted 812 into adjacent wire passages in a single insertion motion. In some cases up to four wires (e.g., from two pairs of twisted wires) or more are simultaneously inserted 812 into adjacent wire passages of a single toggle.

Figure 21D:
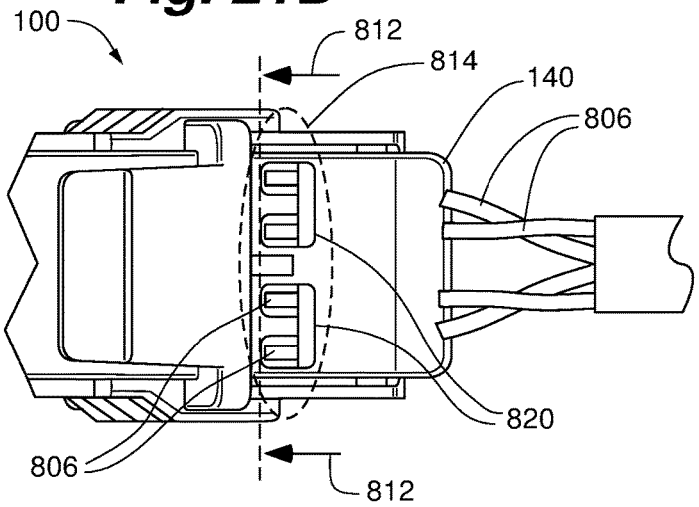
Figure 21E:
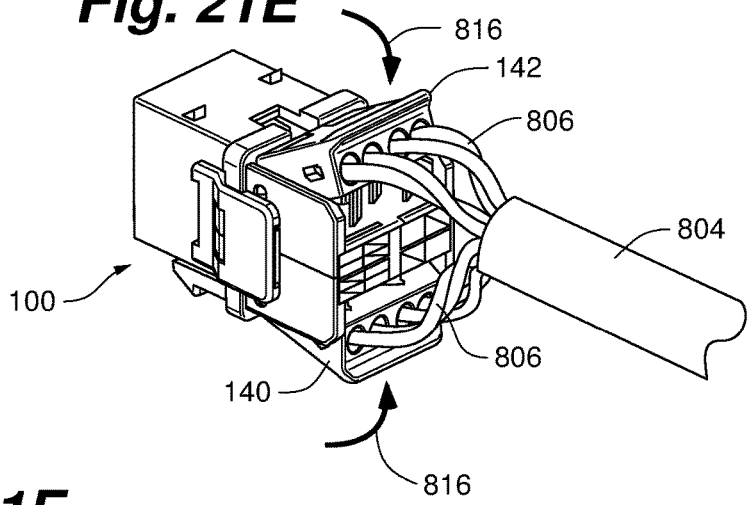

Turning to FIG. 21D, in some embodiments a termination method includes viewing the insertion 812 of the pairs of twisted wires into the wire passages through one or more viewing apertures 820 in the toggles. In FIG. 21D, the area of viewing is represented with a dashed line 814. Viewing the wire insertion in this way can provide a person with an indication as to whether the wires are fully inserted into the wire passages of the toggles 140, 142 or whether the wires may need to be inserted into the passages further.

Figure 21F:
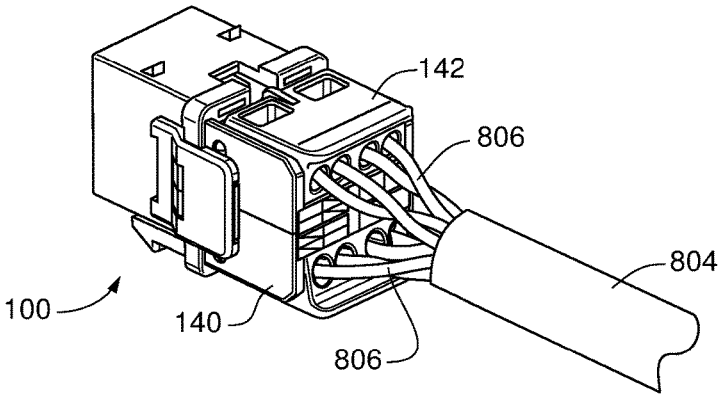

FIG. 21F provides a view of the jack 100 after the wires 806 have been inserted into the toggles 140, 142, and also after the toggles have been rotated closed. Rotating the toggles closed in this manner electrically connects the wires 806 with the electrical terminals extending from the jack's terminal support.

Accordingly, the jack 100 enables a straightforward method for terminating the wires 806 that does not require a special tool, such as a punch down tool, to terminate the wires. Instead, a standard tool such as a knife or wire cutter can be used to remove the length 800 of cable jacket 802 shown in FIG. 21A, and a person can separate, untwist and insert the wires into the toggles 140, 142 by hand. Pivoting the toggles closed can also be accomplished by hand, thus completing the termination of the wires in a relatively simple and straightforward manner.

Although not shown, various termination methods may include further steps, including attaching the jack 100 shown in FIGS. 21A-21F to a modular mounting plate, and mounting the plate and jack to a desired support surface. In addition, a catch system of detents may be used to maintain the rotation of the first and second toggles away from the terminal support. Maintaining the toggles in this open position can facilitate insertion of the wires into the toggles.

It should be noted that, as used in this specification and the appended claims, the singular forms "a," "an," and "the" include plural referents unless the content clearly dictates otherwise. Thus, for example, reference to an apparatus containing "a member" includes a device having two or more members. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as "arranged", "arranged and configured", "constructed and arranged", "constructed", "manufactured and arranged", and the like.

This application is intended to encompass adaptations and variations of the teachings disclosed herein. It should be understood that the above description is intended to be illustrative, and not restrictive.

What is claimed is:

1. A modular jack, comprising:

a housing comprising a connection end, a termination end, and a terminal support, the connection end having a plug opening configured to receive a cable plug, the termination end located opposite and facing away from the connection end, and the terminal support comprising a first side and a second side opposite the first side, the first and second sides located between the connection end and the termination end;

a plurality of first side terminals and a plurality of second side terminals;

a first toggle adjacent to the first side of the terminal support, the first toggle comprising an insertion end proximate the termination end of the housing, facing away from the plug opening, a pivot end pivotally coupled to the housing between the connection end and the termination end, and a first body extending between the insertion end and the pivot end, the first body comprising a plurality of separate first wire passages and a plurality of first terminal channels; and a second toggle adjacent to the second side of the terminal support, the second toggle comprising an insertion end proximate the termination end of the housing, facing away from the plug opening, a pivot end pivotally coupled to the housing between the connection end and the termination end, and a second body extending between the insertion end and the pivot end, the second body comprising a plurality of separate second wire passages and a plurality of second terminal channels;

wherein each of the first and second wire passages extends into the first and second bodies, respectively, from the insertion ends of the first and second toggles, respectively;

wherein each of the first and second wire passages is configured to receive an end of a wire from a communications cable in a single insertion motion;

wherein each of the first terminal channels guides one of the first side terminals through a section of one of the first wire passages to terminate a wire therein as the first toggle is pivoted from an open position to a closed position; and wherein each of the second terminal channels guides one of the second side terminals through a section of one of the second wire passages to terminate a wire therein as the second toggle is pivoted from an open position to a closed position.

2. The jack of claim 1, wherein the housing comprises first side walls extending from the first side of the terminal support, and second side walls extending from the second side of the terminal support opposite the first side walls, and wherein the first toggle is pivotally coupled between the first side walls and the second toggle is pivotally coupled between the second side walls.

3. The jack of claim 1, wherein the housing comprises a terminal portion and a connector portion that are removably connected.

4. The jack of claim 1, wherein the housing comprises a terminal portion comprising removably connected first and second halves, wherein the first toggle is pivotally coupled to the first half and wherein the second toggle is pivotally coupled to the second half.

5. The jack of claim 1, wherein the housing further comprises a first catch system for the first toggle and a second catch system for the second toggle, each of the catch systems comprising two detent members configured to alternately maintain the corresponding toggle in the open position and in the closed position.

6. The jack of claim 1, wherein each of the first and second wire passages extends from a first end at the insertion end of the first and second toggles, respectively, to a second end located within the first and second toggles, respectively.

7. The jack of claim 6, wherein at least one of the first and second toggles comprises a viewing aperture in communication with the second end of at least one wire passage.

8. The jack of claim 6, wherein each of the first and second wire passages comprises a funnel portion at the first end and a straight portion between the funnel portion and the second end.

9. A method for terminating a communications cable, the method comprising:

removing a length of cable jacket from an end of a communications cable comprising multiple pairs of twisted wires;

separating the pairs of twisted wires at the end of the communications cable;

untwisting the ends of each pair of twisted wires;

bringing the end of the communications cable near a communications jack, the jack comprising a cable plug opening, first and second toggles pivotally coupled on opposite sides of a terminal support, and first side terminals and second side terminals extending from corresponding first and second sides of the terminal support, each of the first and second toggles having an insertion end facing away from the plug opening and a pivot end opposite the insertion end;

inserting, with a single motion, the untwisted ends of a first pair of twisted wires into two first wire passages in the insertion end of the first toggle;

inserting, with a single motion, the untwisted ends of a second pair of twisted wires into another two first wire passages in the insertion end of the first toggle;

pivoting the first toggle toward the first side of the terminal support to intersect each of the first wire passages with a corresponding first side terminal, thereby forming an electrical connection between each of the wires of the first and second pairs of twisted wires and corresponding first side terminals;

inserting, with a single motion, the untwisted ends of a third pair of twisted wires into two second wire passages in the insertion end of the second toggle;

inserting, with a single motion, the untwisted ends of a fourth pair of twisted wires into another two second wire passages in the insertion end of the second toggle; and pivoting the second toggle toward the second side of the terminal support to intersect each of the second wire passages with a corresponding second side terminal, thereby forming an electrical connection between each of the wires of the third and fourth pairs of twisted wires and corresponding second side terminals.

10. The method of claim 9, further comprising pivoting the first and the second toggles into first and second termination bays, respectively, wherein the first termination bay comprises first side walls and the first side of the terminal support, and wherein the second termination bay comprises second side walls and the second side of the terminal support.

11. The method of claim 9, further comprising attaching the jack to a mounting plate.

12. The method of claim 9, wherein the jack is integrally attached to a mounting plate.

13. The method of claim 9, wherein the first wire passages extend into the first toggle but not through the pivot end of the first toggle, and wherein the second wire passages extend into the second toggle but not through the pivot end of the second toggle.

14. The method of claim 13, further comprising viewing the inserting the untwisted ends of the first and second pairs of twisted wires through one or more viewing apertures in the first toggle and viewing the inserting the untwisted ends of the third and fourth pairs of twisted wires through one or more viewing apertures in the second toggle.

15. The method of claim 9, further comprising pivoting the first and the second toggles away from the first and second sides of the terminal support, respectively, before inserting the untwisted ends of the pairs of twisted wires into the first and second wire passages.

16. The method of claim 15, further comprising maintaining a rotation of the first and the second toggles away from the terminal support with a detent system.

17. A communications jack, comprising:

a mounting plate configured to be mounted to a support surface, the mounting plate comprising an inner side configured to face the support surface, an outer side opposite the inner side, and an opening extending through the outer and inner sides, the opening configured to receive a cable plug;

a housing comprising a connector portion connected to the mounting plate and a terminal portion connected to the connector portion opposite the mounting plate, the connector portion comprising a plug receptacle in communication with the opening of the mounting plate and the terminal portion comprising a terminal support comprising first side terminals and second side terminals extending from corresponding first and second sides of the terminal support; and first and second toggles pivotally coupled on opposite sides of the terminal support, each of the first and second toggles comprising an insertion end facing away from the mounting plate, a pivot end opposite the insertion end, four wire passages extending into the toggle from the insertion end but not extending through the pivot end, each of the wire passages configured to receive an end of a wire from a communications cable in a single insertion motion, and four terminal channels, each one of the terminal channels intersecting a corresponding wire passage;

wherein each of the first and the second toggles has an open position in which the toggle is rotated away from the terminal support for loading ends of wires into the wire passages of the toggle;

wherein each of the first and the second toggles has a closed position in which the toggle is rotated toward the terminal support; and wherein rotating the first and second toggles from the open positions to the closed positions, respectively, inserts corresponding first side and second side terminals into the terminal channels of the first and second toggles, respectively, to electrically terminate ends of wires in the wire passages of the toggle.

18. The jack of claim 17, wherein the terminal portion and the connector portion are removably connected.

19. The jack of claim 17, wherein the first toggle comprises a first viewing aperture in communication with two wire passages in the first toggle and a second viewing aperture in communication with another two wire passages in the first toggle, and wherein the second toggle comprises a third viewing aperture in communication with two wire passages in the second toggle and a fourth viewing aperture in communication with another two wire passages in the second toggle.

20. The jack of claim 17, wherein the terminal portion further comprises a first catch system for the first toggle and a second catch system for the second toggle, each of the catch systems comprising two detent members configured to alternately maintain the corresponding toggle in the open position and in the closed position.

* * * * *